US009783266B2

(12) United States Patent
Hough

(10) Patent No.: US 9,783,266 B2
(45) Date of Patent: Oct. 10, 2017

(54) ARTICULATED TOP

(71) Applicant: Dowco, Inc., Manitowoc, WI (US)

(72) Inventor: Justin B. Hough, Lebanon, MO (US)

(73) Assignee: Dowco, Inc., Manitowoc, WI (US)

( * ) Notice: Subject to any disclaimer, the term of this patent is extended or adjusted under 35 U.S.C. 154(b) by 0 days.

(21) Appl. No.: 15/373,191

(22) Filed: Dec. 8, 2016

(65) Prior Publication Data

US 2017/0088238 A1 Mar. 30, 2017

Related U.S. Application Data

(63) Continuation of application No. 15/347,479, filed on Nov. 9, 2016, which is a continuation-in-part of application No. 14/934,291, filed on Nov. 6, 2015, now Pat. No. 9,604,702.

(60) Provisional application No. 62/076,971, filed on Nov. 7, 2014.

(51) Int. Cl.
*E04H 15/34* (2006.01)
*B63B 17/02* (2006.01)

(52) U.S. Cl.
CPC ..... *B63B 17/02* (2013.01); *E04H 15/34* (2013.01); *B63B 2710/00* (2013.01)

(58) Field of Classification Search
CPC ..... E04H 12/34; E04H 15/06; E04H 15/34; E04H 15/36; E04H 15/46; E04H 15/48; E04H 15/02; B63B 17/02; B60J 7/12
USPC ..... 135/88.07, 88.13, 88.15–88.17, 117, 135/120.3, 132–133, 139, 151, 96; 296/107.13, 107.12, 100.12, 100.17, 156, 296/163; 114/361, 343; 248/188.1, 248/188.5
See application file for complete search history.

(56) References Cited

U.S. PATENT DOCUMENTS

| | | | | |
|---|---|---|---|---|
| RE5,094 E * | 10/1872 | Mathewson | ..... | 248/407 |
| 3,489,452 A | 1/1970 | Plante | | |
| 3,930,645 A * | 1/1976 | Anderson | ..... | B25J 1/04 248/354.1 |
| 4,928,916 A * | 5/1990 | Molloy | ..... | E04F 21/1805 248/354.1 |

(Continued)

FOREIGN PATENT DOCUMENTS

| | | |
|---|---|---|
| JP | 06090605 | 4/1994 |
| WO | 2008010909 | 1/2008 |

OTHER PUBLICATIONS

Website screenshot of PWR-ARM Automatic Bimini Top; https://pwr-arm.com; obtained from the Internet Archive Jun. 15, 2013.

(Continued)

*Primary Examiner* — Winnie Yip
(74) *Attorney, Agent, or Firm* — Shane Delsman; Godfrey & Kahn, S.C.

(57) ABSTRACT

A frame for a top of a boat in accordance with the present invention can be moved into a deployed position with the aid of a biasing member such that the manual effort required is minimized. When the frame is in the deployed position a locking member may be engaged to hold the frame and top in the deployed position and a ratcheting strut may be used to secure the frame in place. When the locking member is disengaged, the frame may be manually collapsed into a stowed position in a controlled and safe manner.

20 Claims, 34 Drawing Sheets

(56) References Cited

U.S. PATENT DOCUMENTS

| | | | | |
|---|---|---|---|---|
| 5,472,301 | A * | 12/1995 | Wallen | B61D 45/001 410/143 |
| 5,645,309 | A | 7/1997 | Graf | |
| 5,706,752 | A | 1/1998 | Menne, Jr. et al. | |
| 5,803,104 | A | 9/1998 | Pollen | |
| 6,152,434 | A * | 11/2000 | Gluck | E04F 21/1805 254/114 |
| 6,209,477 | B1 | 4/2001 | Biedenweg | |
| 6,666,163 | B2 | 12/2003 | Pastor | |
| 6,672,241 | B2 | 1/2004 | Warfel | |
| 6,851,652 | B1 * | 2/2005 | Huang | E04G 25/08 248/200.1 |
| 6,983,716 | B1 | 1/2006 | Ankney et al. | |
| 7,063,035 | B2 | 6/2006 | Belcher | |
| 7,162,968 | B2 * | 1/2007 | Thompson | B63B 17/02 114/361 |
| 7,204,466 | B2 | 4/2007 | Hsieh | |
| 7,536,971 | B1 | 5/2009 | Fry | |
| 7,571,691 | B2 | 8/2009 | Russikoff | |
| 7,895,964 | B2 | 3/2011 | Russikoff | |
| 7,921,797 | B2 | 4/2011 | James | |
| 7,950,342 | B2 | 5/2011 | Russikoff | |
| 8,052,110 | B2 * | 11/2011 | Wang | E04G 25/06 248/354.1 |
| 8,590,849 | B2 | 11/2013 | Melic | |
| 8,616,511 | B2 | 12/2013 | James | |
| 8,708,100 | B2 | 4/2014 | Schwoerer | |
| 8,752,498 | B1 | 6/2014 | Schwindaman et al. | |
| 8,973,899 | B2 * | 3/2015 | Buckingham | E04G 25/061 254/105 |
| 2008/0066794 | A1 | 3/2008 | Durfee | |
| 2011/0290170 | A1 | 12/2011 | Russikoff | |
| 2013/0206050 | A1 | 8/2013 | Russikoff | |

OTHER PUBLICATIONS

Website screenshot of YouTube; PWR-ARM II, by Schwintek Inc.; uploaded on Oct. 19, 2011.

Website screenshot of Dowco Marine Inc.; http://www.dowcomarine.com/; obtained from the Internet Archive Jun. 23, 2015.

Website screenshot of Dowco Replacement Aft Top Canopy; Prior art for purposes of prosecution.

Peloton Precision Bicycle Products Hitch Perfect : Kuat NV product information; 2014 Move Press LLC.

* cited by examiner

ARTICULATED TOP

CROSS REFERENCE TO RELATED APPLICATION

This continuation application claims the benefit of and priority to U.S. application Ser. No. 15/347,479, filed Nov. 9, 2016, which is a continuation-in-part and claims the benefit of and priority to U.S. application Ser. No. 14/934,291, filed Nov. 6, 2015, which claims the benefit of and priority to U.S. Provisional Patent Application Ser. No. 62/076,971, the disclosures of which are hereby incorporated by reference, herein, in their entirety, for all purposes.

FIELD OF THE INVENTION

The present invention relates generally to the field of water craft. More specifically, the present invention relates to articulating tops for water craft.

BACKGROUND

Boats can be equipped with some form of sun shade apparatus or other enclosure such as a top, canopy or bimini. Some tops can be moved between an extended, engaged, locked or radar position and a stowed, collapsed, unlocked or trailering position. Some tops are constructed out of tubular frames that articulate to at least two positions. Some such tops can be manually articulated to a desired position, while others utilize mechanical aids such as hydraulics or electric motors to power the apparatus into the desired position(s).

The manual articulation of tops often require a significant effort to move the top into the desired position(s). One common method for manually articulating a top is to manually lift the top into the desired state, such as an extended position. Then, the top can be secured in position by latching or locking a frame member, such as a bow, arm or strut, such as to hardware that is attached to the water craft. Such manual articulation requires significant strength to raise the top into position, and dexterity and balance to secure the top in position. Such manual articulation can be unsafe if undertaken by a single person.

Some tops have been designed such that they use gravity to pull the top into the stowed position when released from the extended position. However, when released, such tops violently collapse, which can injure someone in the path of the top, damage the top and/or the water craft or be noisy, potentially scaring away wildlife. Other tops may use powered mechanical systems to decrease or even eliminate the need for manual articulation. However, such powered tops are often cost prohibitive and may not be useable with all boat models, as such powered tops can require specific structural elements for mounting thereto and power.

Even once the top has been raised generally into its deployed position, the top must then be secured and tensioned. Typically, such tops have utilized one of two components to secure and tension the front of the top.

One such component is a strap. The strap is attached to the top front of the frame. Once the top is in its deployed position, the strap can be attached to the boat and then tightened to tension and secure the top in its deployed position. Straps can have a pulley or block and tackle system and a handle that can allow applying tension and removing tension relatively easy and are generally more affordable. However, straps can wear out and are seen by some in the boating community as cheap, weak and undesirable.

Another such component is a strut. Like a strap, the strut is connected to the top front of the frame. Once the top is in its deployed position, the front top of the frame must be pulled down and then the strut attached to the boat. Such attachment is often putting a pin through the strut and an attachment mechanism on the boat. Unlike with the strap, such maneuvering typically requires two people to accomplish and the strut tends to be more expensive. Further, the strut needs to be the correct length so as to ensure the proper tension is applied when the strut is attached to the boat. However, the strut is less likely to wear out in comparison to the strap and seen by some in the boating community more luxurious, strong and desirable.

Therefore, there is need for a cost effective top that decreases the effort required to manually articulate the top and to tension and secure the top in its deployed position. There is also a need for a top that can be manually articulated by one person without a sudden collapsing of the top and that can be securely stowed, such as for transportation and storage.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
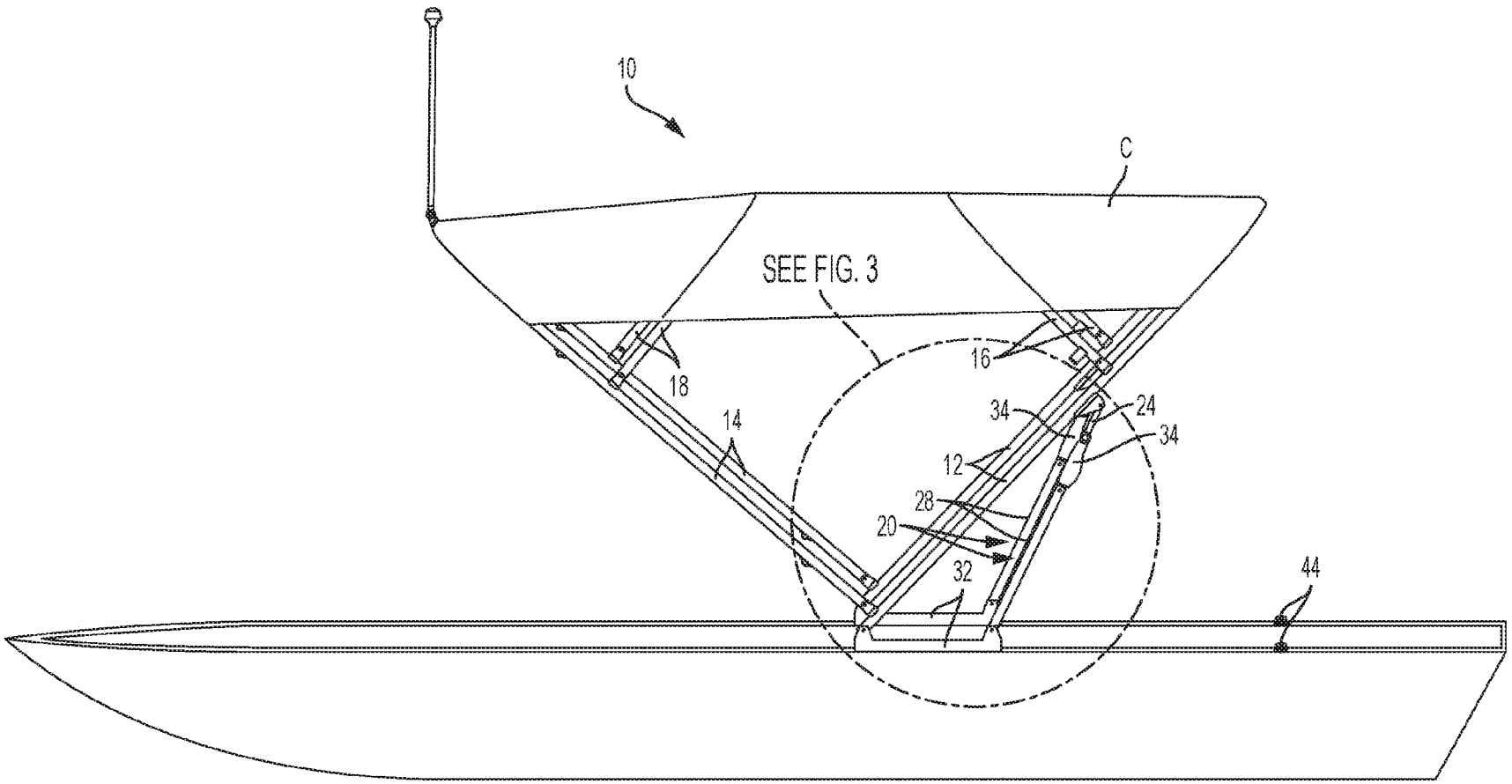
FIG. 1 is an elevation view of a frame in a deployed position.
Figure 2:
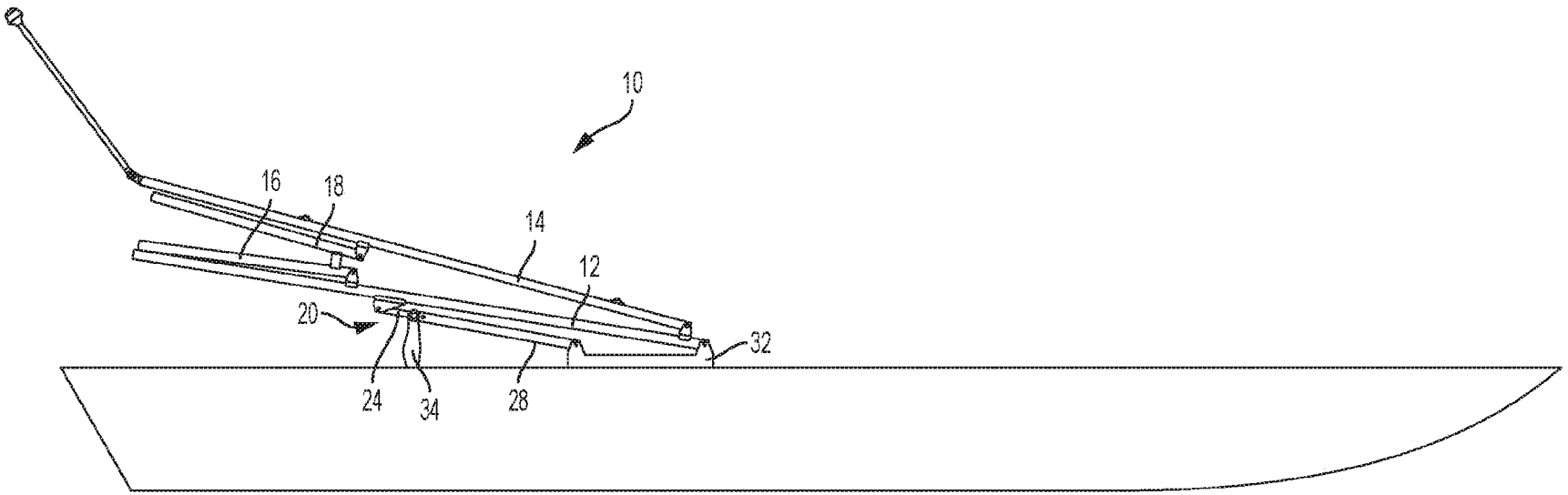
FIG. 2 is an elevation view of the frame of FIG. 1 in a collapsed position.

As seen in FIG. 1, a frame 10 for a marine top, canopy, bimini or other such structure is shown. The frame 10 shown in FIG. 1 is generally comprised of tubular members that support a canvas or other suitable material (C) for providing shade or shelter from the elements. For example, the frame 10 in FIG. 1 includes a main or aft bow 12 that is pivotally connected to a secondary or bow bow 14. One or more auxiliary bows 16, 18 can be pivotally connected to the main and secondary bows. The pivotal connections allow the frame 10 to collapse into a compact folded frame as seen in FIG. 2. Support members 20, for example, one on the starboard side and one on the port side of the frame 10, may also be used to support and keep the frame in the deployed and/or collapsed position.

In the embodiment shown in FIG. 1, the support members 20 include a biasing member. The biasing member is shown in FIG. 1 as a gas shock 22, but could also include a mechanical or pneumatic spring, shock or damper. The gas shock 22 is connected at a first end to a first end of the strut or shaft 24, such as by a threaded end of the rod being thread into a threaded hole in the strut, and is pivotally connected, directly or indirectly, at its second end to the vehicle or structure such as a boat.

The strut 24 is pivotally connected at its second end to the frame 10 or a collapsible assembly, for example the main bow 12. For example, the strut 24 may have a bore (not shown) formed in one end and a plastic hat-style washer (not shown) inserted in each side of the hole. A frame bracket is then secured to the main bow, such as by screws or bolts. The frame bracket has flanges sized to accept the strut with hat-style washers and each flange has a hole matching the hole in the hat-style washers such that mating shoulder bolts may be inserted through the holes in the frame bracket, hat-style washers and strut 24 to pivotally connect the strut to the main bow. When the frame 10 is moved from the collapsed position, the gas shock 22 is allowed to push the rod 26 further out which in turn pushes the strut 24 out of the tube 28 and causes the main bow 12 and frame 10 to move to its deployed position. When the frame 10 is moved from its deployed position towards its collapsed position, the main bow 12 will push on the strut 24 causing the rod 26 to be pushed in or withdrawn further into the gas shock 22.

In one embodiment, the gas shock 22 could be designed to provide just less than the amount of force required to move the frame 10 from the collapsed position into the extended position such that only a small amount of additional force or effort is needed, for example by a person. Such force would also allow the frame 10 to be collapsed into the stowed position in a safe and controlled manner because the weight of the frame would only slightly overcome the force exerted by the gas shock 22. Therefore, only a small amount of force is needed, for example by a person, to stop or slow the collapse of the frame 10. In this embodiment, the gas shock 22 urges or biases the strut 24 to slide into the tube 28.

By way of another example, the gas shock 22 could be designed to provide a slightly greater force than needed to move the frame 10 from the collapsed position into the extended position such that only a small amount of additional force would be used, for example by a person, to stop or slow the articulation of the frame 10. Such force would also allow the frame 10 to be collapsed into the stowed position in a safe and controlled manner because only a small amount of additional force or effort is used to overcome the force of the gas shock 22. In this embodiment, the gas shock 22 urges or biases the strut 24 to slide out of the tube 28.

Figure 3:
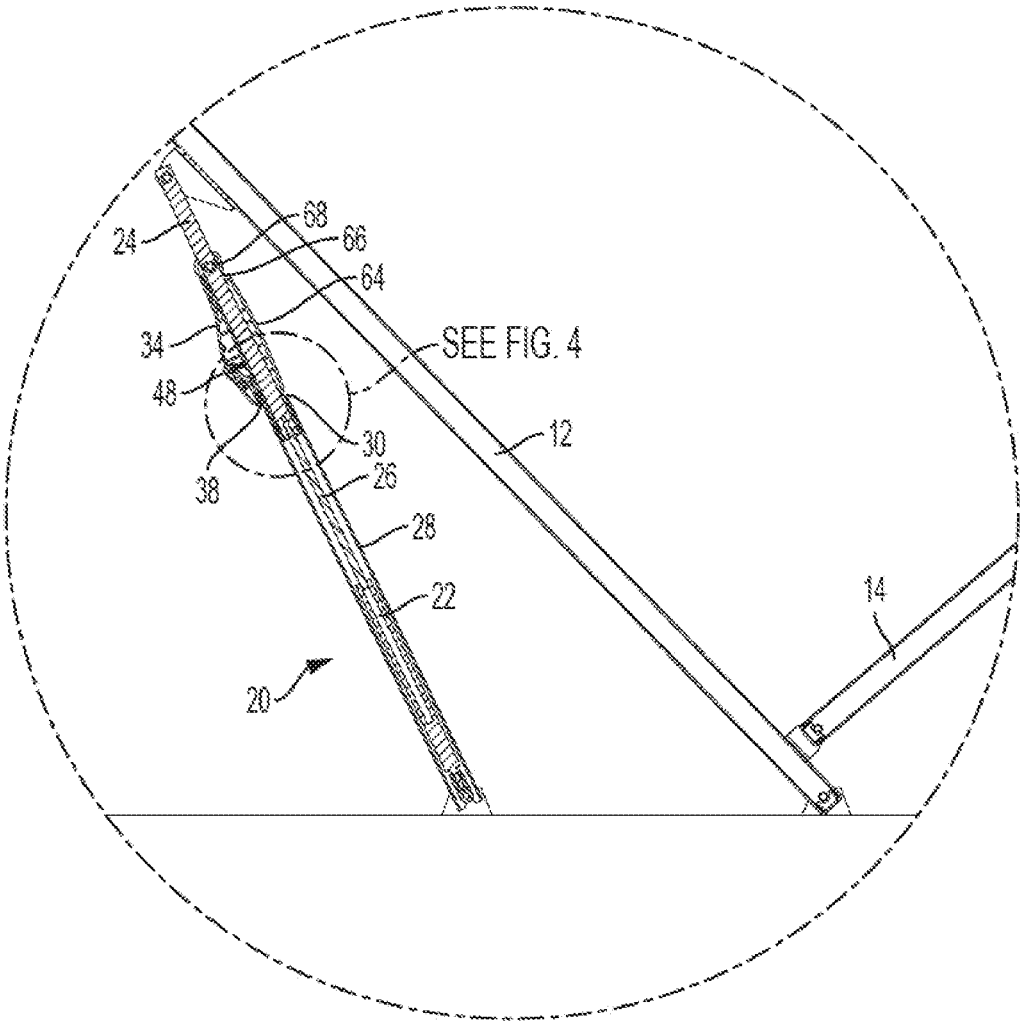
FIG. 3 is an enlarged elevation view of a portion of the frame of FIG. 1 attached directly to a water craft.

In the embodiment shown in FIG. 3, the gas shock 22 is housed within a tube, housing or shroud 28 and the tube slidable receives the strut 24. At one end of the tube 28 is a bushing or collar 30. In FIG. 3, the bushing 30 is located at least partially within the opening of the tube 28. The bushing 30 can slidably receive the strut 24 and help guide the strut as it slides in and out of the tube 28, such as, for example, by keeping the strut centered, providing a smooth surface for the strut to slide against and the preventing the strut from undesired racking or twisting. The bushing 30 could be attached to the tube 28 or the bushing could be integrally formed or made with the tube.

The support member 20 is shown attached at its second end to a mounting bracket 32. The second end of the gas shock 22 and/or the tube 28 can be attached directly to the marine vehicle or structure, e.g. a rail or fence, as seen in FIG. 3, or could be attached to another structure such as a mounting bracket 32 which is then attached to the marine vehicle or structure, as seen in FIGS. 1-2. For example, the tube 28 may have a bore (not shown) that matches a hole in the flanges (not shown) of the mounting bracket. Hat-style washers (not shown) are inserted into each side of the bore in the tube 28. Mating shoulder bolts are inserted through the hat-style washers, the tube 28 and an eyelet threadingly connected to the gas shock 22 to pivotally connect the tube and gas shock to the mounting bracket 32. The main bow 12 can also be pivotally attached to the mounting bracket 32.

Fixing or predetermining the relationship of the second ends of the main bow 12 and support member 20 can make installation easier because the proper relationship between the main bow and support member, e.g. angle formed by the main bow and mounting bracket 32 and distance between the second ends of the main bow and the support member, does not need to be determined or measured during installation. The proper relationship can also lead to increased safety and life of the frame 10 by, for example, inhibiting torquing and proper distribution of the weight of the top on the main bow 12 and the support members 20. Fixing or predetermining the relationship of the second ends of the main bow 12 and support member 20 also allows a single sized support member to be used for a variety of sized tops and frames by adjusting the size of the mounting bracket 32.

Figure 6:
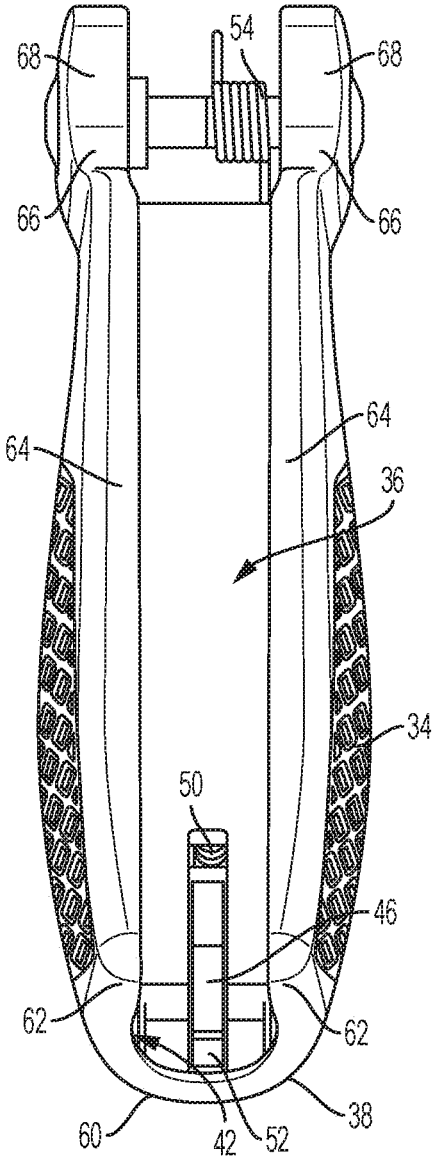
FIG. 6 is an enlarged perspective view of the locking member of the frame of FIG. 3.
Figure 7:
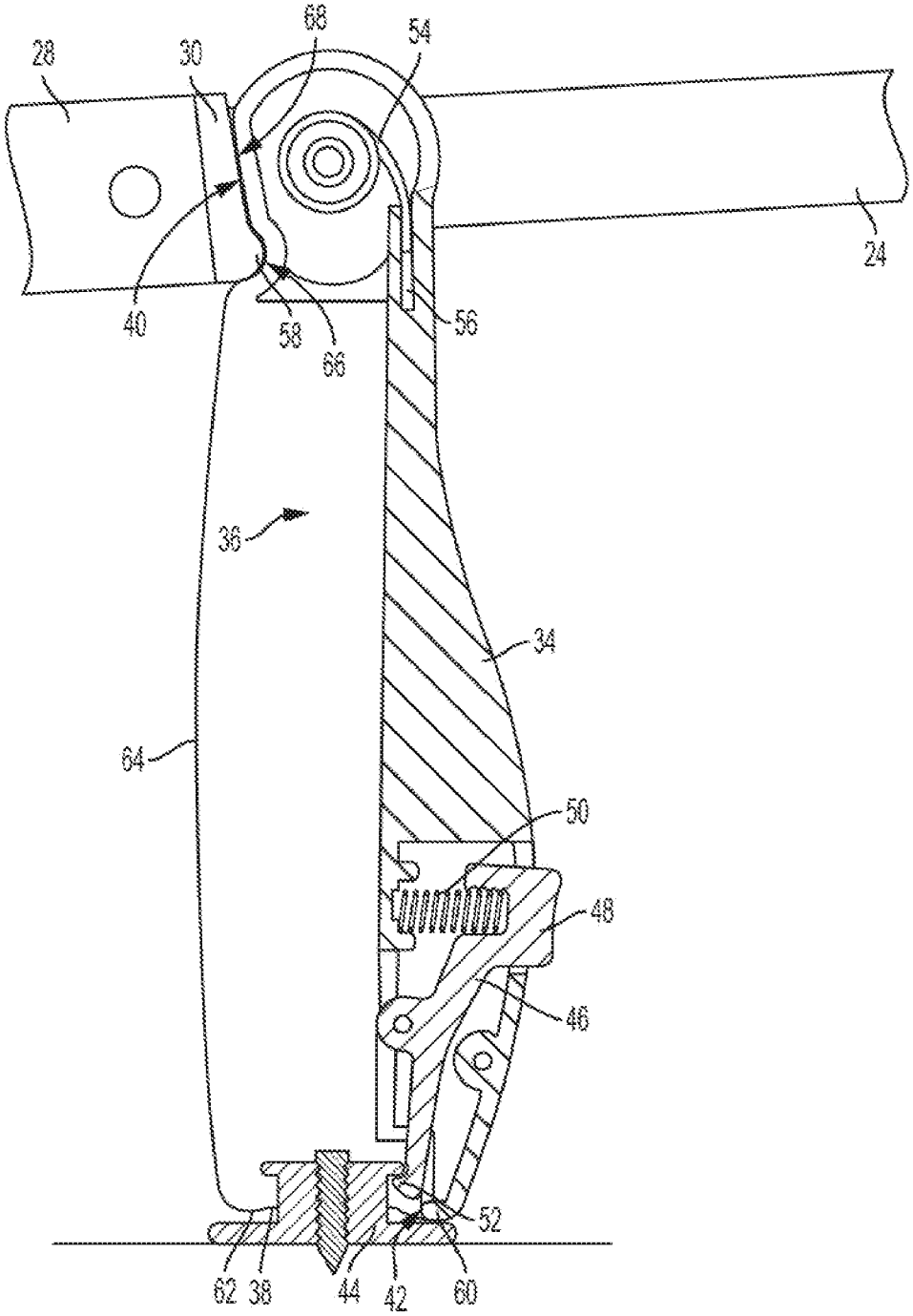
FIG. 7 is a cross-sectional elevation view of the locking member of FIG. 3 in an opened position engaged to a structure.

The support members 20 can also include a locking member to lock the support member in the closed position, such as when the frame 10 is deployed, and/or the opened position, such as when the frame is collapsed. In FIGS. 1-11, 13, the locking member is a handle or lever that is pivotally connected to the strut 24, such that the locking member is movable between opened and closed positions. For example, the handle 34 may have a bore (not shown) that matches a bore (not shown) in the strut 24 when the strut is within the handle as discussed further below. Mating shoulder bolts may be inserted through the two bores to pivotally mount the handle 34 to the strut 24 at one end of the handle. When the frame 10 is in its deployed position, the handle 34 is closed and generally in line with the support member 20 as seen in FIG. 3. The handle 34 includes a slot 36 that is sized and positioned to accept the strut 24 when the handle is closed seen most clearly in FIG. 5. When the frame 10 is collapsed, the handle is opened and is generally perpendicular to the support member 20 as seen in FIG. 7.

Figure 4:
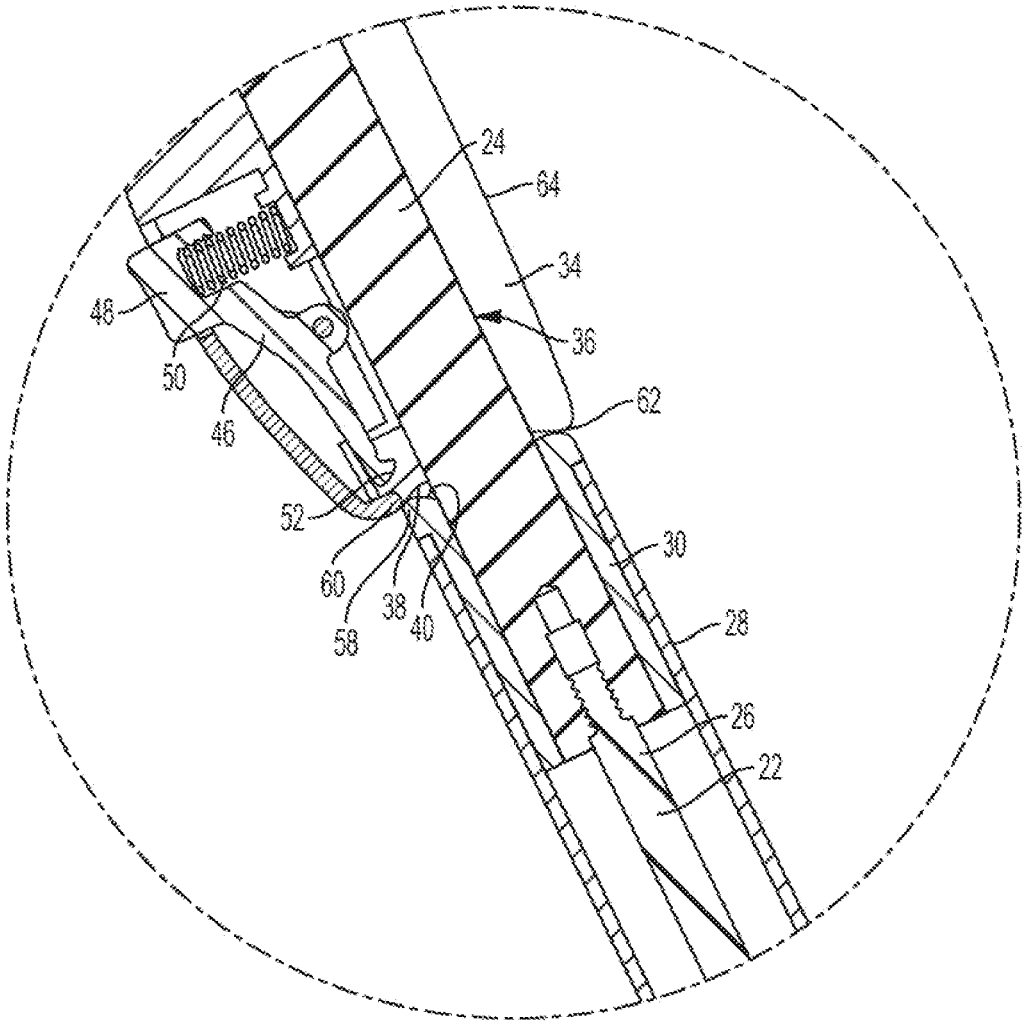
FIG. 4 is an enlarged elevation view of a portion of the frame of FIG. 3.
Figure 5:
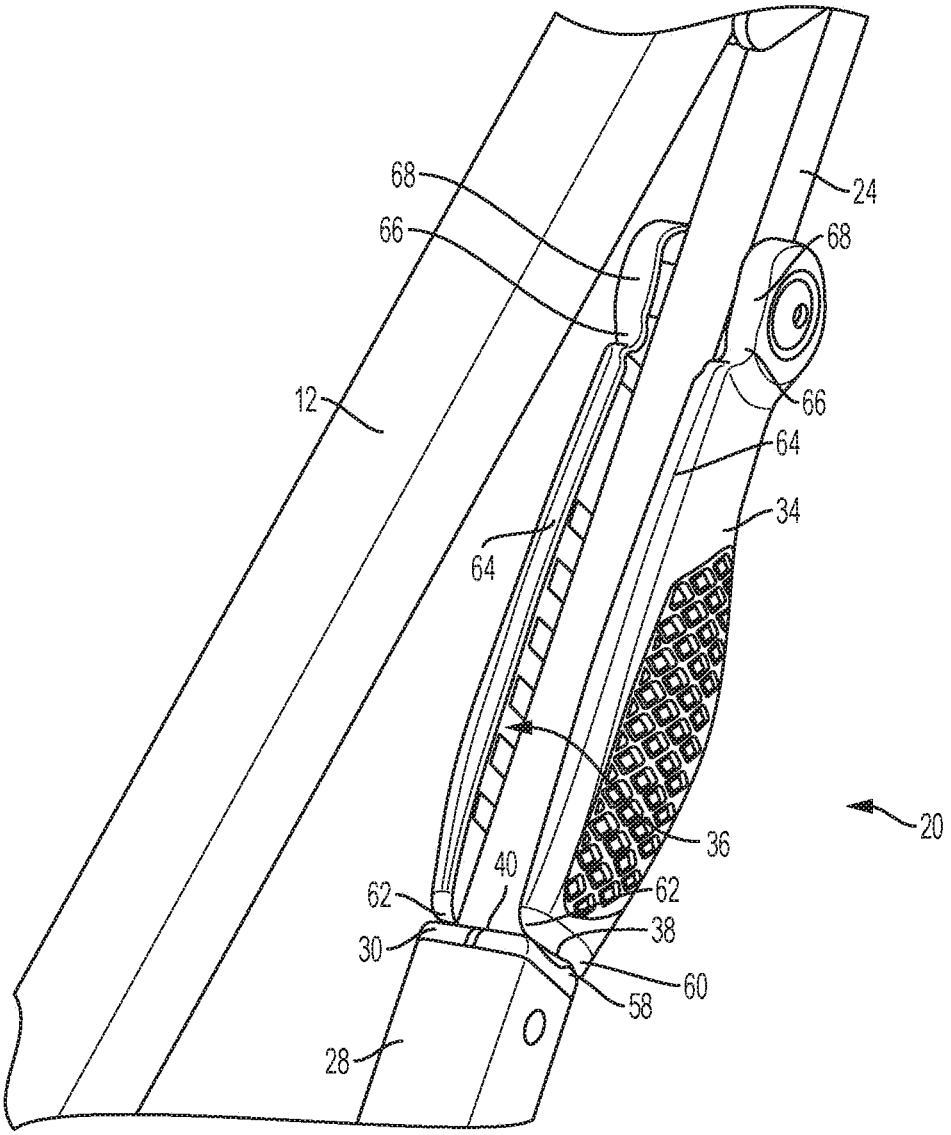
FIG. 5 is an enlarged perspective view of a portion of the frame of FIG. 1 in a closed position.

When the frame 10 is in the deployed position and the handle 34 is in a first position or closed, as seen in FIG. 4, the bottom surface 38 of the handle contacts, jams or engages the top or contact surface 40 of the bushing 30 to prevent the strut 24 from being pulled or sliding further within the tube 28 from the weight of the frame 10 and/or the tensile force or pull of the gas shock 22. When the handle is in the closed position, the frame 10 is fully deployed. Thereby, the handle 34 can be used to set the length and angle of the support member at which the frame 10 is fully deployed.

Figure 8:
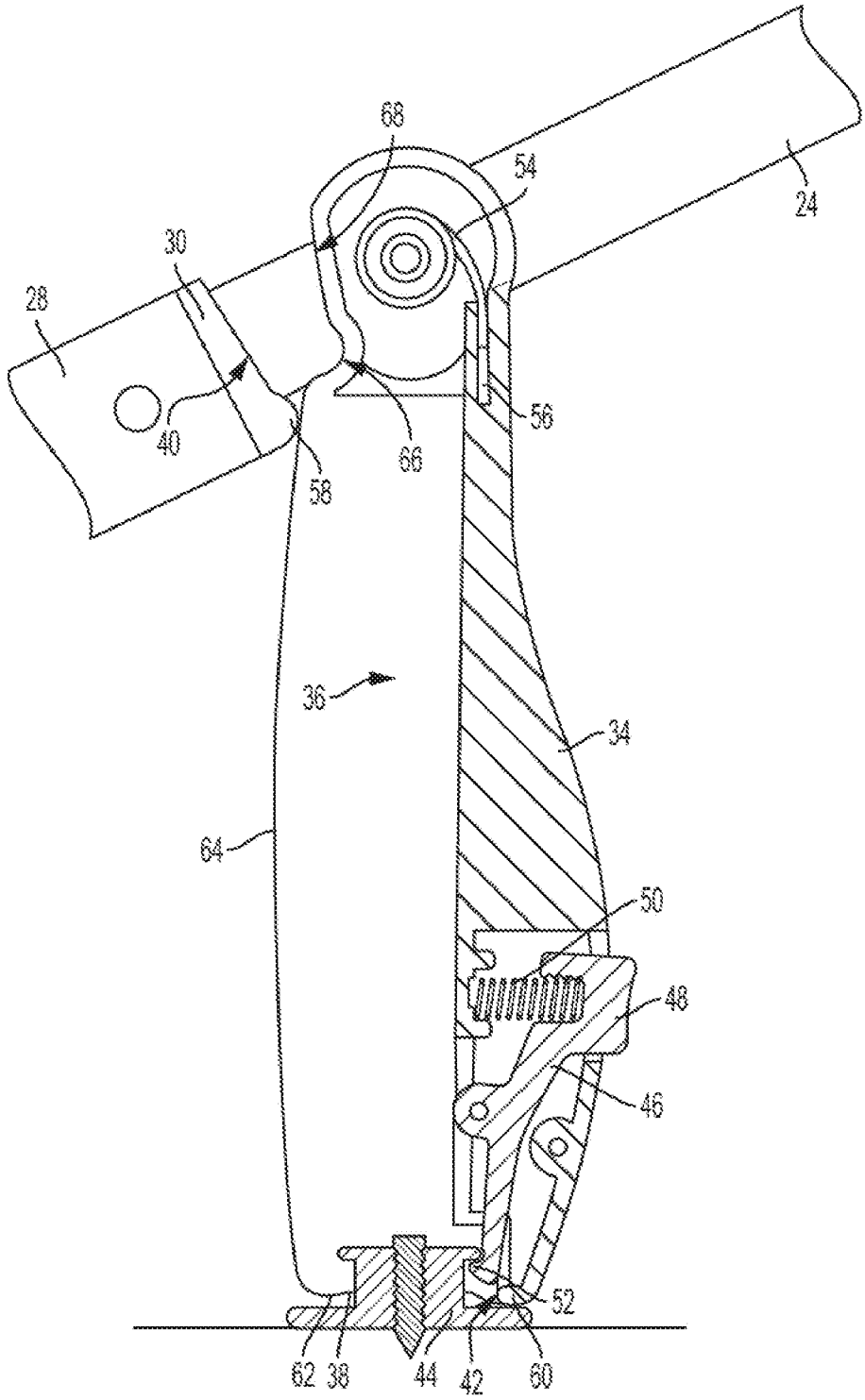
FIG. 8 is a cross-sectional elevation view of the locking member of FIG. 3 in an opened position.
Figure 9:
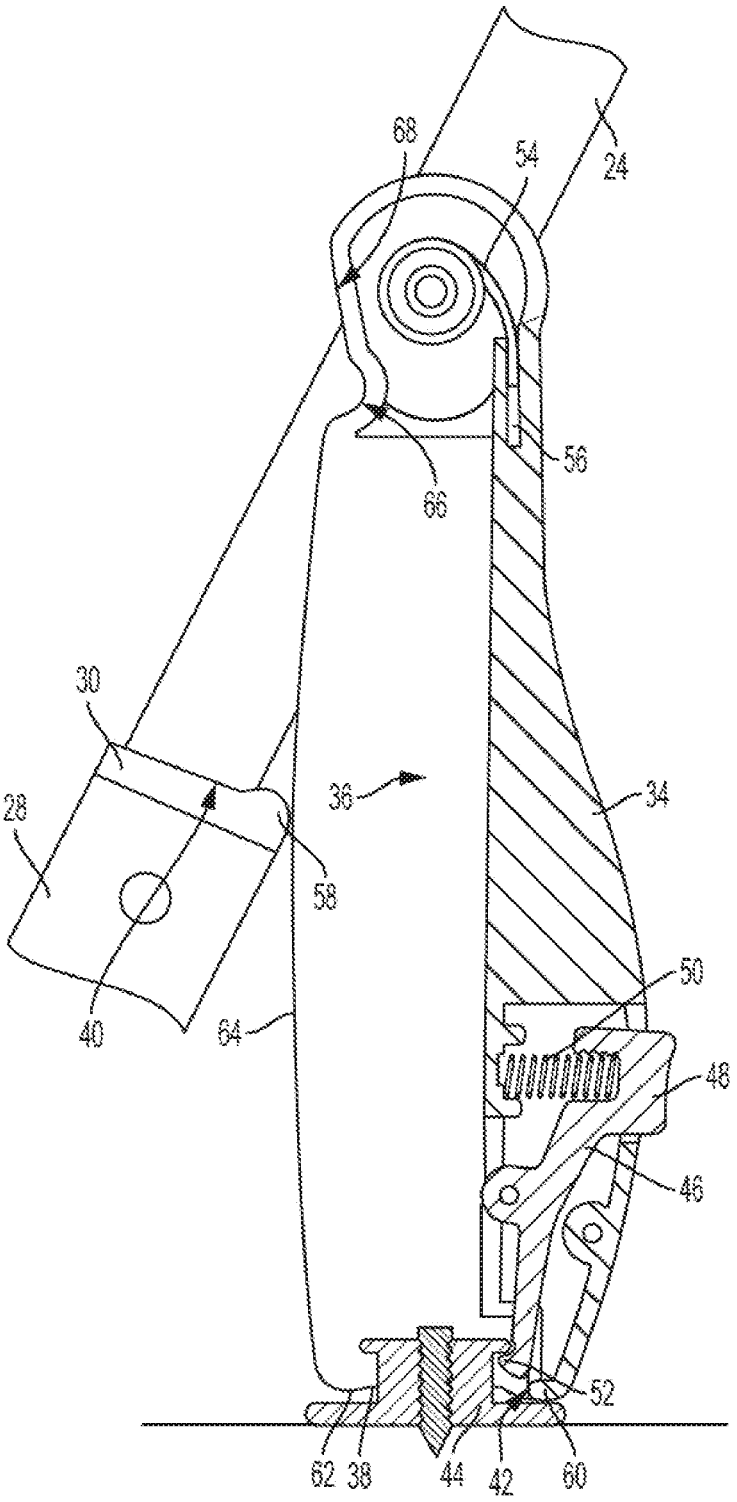
FIG. 9 is a cross-sectional elevation view of the locking member of FIG. 3 in an opened position.

When it is desired to collapse the frame 10, e.g. when towing a marine vehicle to which the frame is attached, the handle 34 can be disengaged from the bushing by pulling the handle and rotating the handle away from the support strut as seen in FIGS. 7-9. In this position, the handle 34 is in a second position or opened. When the handle 34 is in the open position, the strut 24 is not prevented from being pulled or sliding further within the tube 28 by the weight of the frame 10 and/or the tensile force or pull from the gas shock 22.

The handle 34 may also include a securing component to secure the frame 10 in a collapsed position. For example, as best seen in FIG. 6, the securing component is a socket 42 formed in the bottom of the slot 36. In the embodiment shown in FIGS. 6-7, the socket 42 is sized and shaped to selectively attach or fit over a structure, for example a deck button 44.

As seen in FIG. 7, a latch 46 is housed in and rotatably secured or pivotally connected to the handle 34. At a first end of the latch 46 is a push button 48. Between the push button 48 and the handle 34 is a spring 50 that urges the push button out of the handle. At the second end of the latch is a lip or flange 52. The spring 50 also urges the lip 52 into the slot 36.

To secure the frame 10 in the collapsed position, the socket 42 of the handle 34 is slid over the deck button 44. As the deck button 44 contacts the lip 52, the force pushes the lip away from the deck button and thereby, moves the latch to rotate to allow the deck button to further enter the slot 36 through the socket 42. Once the top of the deck button 44 moves past the lip 52, the spring 50 will cause the latch to rotate towards engagement with the deck button such that the lip 52 slides under the top of the deck button to secure the handle 34 and, thereby, the frame 10 to the marine vehicle or structure to which the deck button is attached. This is the engaged position of the latch. Although the above example uses a deck button, the socket 42 and/or latch 46 could be sized and shaped to connect to a variety of structures.

To release the frame from the deck button, for example, to move the frame to the deployed position, the push button 48 can be depressed causing the lip 52 to retreat from or disengage the deck button 44 and slot 36. With the lip 52 out of the way, the handle 34 can be withdrawn from the deck button. This is the disengaged position of the latch.

The handle 34 can also have a biasing member. For example, as seen in FIGS. 6-7, the handle includes a biasing member shown as a spring 54. The spring 54 is wound, wrapped or positioned over the bolt that pivotally connects the strut 24 to the handle 34. One end of the spring 54 is secured in a recess 56 formed in the back of the handle 34 and the other end of the spring is located in the strut 24. The spring 54 urges or biases the handle towards the closed position.

The contact surface 40 of the bushing 30 may also cooperate with the handle 34 and spring 54 to allow the handle to return to the closed position as the frame is being moved to the deployed position or to otherwise perform as a timing device. For example, as seen in the embodiment shown in FIG. 4, the contact surface 40 includes a raised edge 58. The bottom surface 38 of the handle 34 includes an interference or protuberant 60, 62 at each the front and back of the bottom surface.

When it is desired to move the frame 10 from the deployed position to the collapsed position, the handle 34 can be pulled away from the strut 24. As the handle 34 is pulled away the raised edge 58 will ride along the bottom surface 38 of the handle until the raised edge reaches the rear interference 62 of the bottom surface. A slight increase in the amount of force used to pull the handle 34 forward may be required to cause the rear interference 62 to ride up, over and beyond or past the raised edge 58. In one embodiment, once the rear interference 62 is past the raised edge 58, the handle 34 will be in the open position and the weight of the frame will push the strut 24 down into the tube 28 because the weight of the frame is slightly greater than the resistance provided by the gas shock 22. As the strut 24 is pushed into the tube 28, the spring 54 will urge the handle 34 to maintain contact with the raised edge 58. The raised edge 58 will ride along the rear side 64 of the handle. As the strut 24 is being pushed into the tube 28, the contact between the raised edge 58 and the rear side 64 of the handle will cause the handle to rotate away from the strut 24.

In the embodiment shown in FIGS. 7-9, the raised edge 58 will ride the rear side 64 of the handle 34 until the raised edge reaches a depression 66 formed in the rear side 64 of the handle 34 and at least a portion of the remainder of the contact surface 40 contacts the stop surface 68 near the first end of the handle, as seen in FIG. 7. In this configuration, the handle 34 is in a third position or fully opened and can be placed onto the deck button 44. In the third position, the interaction between the handle 34 and bushing 30 prevents the strut 24 from sliding further into the tube 28 and defines the amount the strut my slide within the tube. As seen in FIGS. 2 and 7-9, as the strut 24 slides into the tube 28, the handle 34 will be rotated further and further out of alignment with the strut, until the handle reaches the third position, wherein the handle is generally perpendicular to the strut.

When it is desired to move the frame 10 to the deployed position, the push button 48 can be depressed to release the deck button 44. Once the deck button 44 is past the lip 52 and the frame is moved towards the deployed position, the strut 24 will be withdrawn from the tube 28. As the strut 24 is withdrawn, the raised edge 58 will be withdrawn from the depression 66 and the spring 54 will cause the handle to maintain contact with the raised edge. The raised edge 58 will then ride along the rear side 64 of the handle 34, as seen in FIGS. 8-9, until it slides around the rear interference 62, the strut 24 enters the slot 36 and the bottom surface 38 contacts the contact surface 40, as seen in FIG. 4. This returns the handle to the closed position. The bottom surface 38 of the handle 34 can also include a front or second interference 60, to prevent the handle from being over rotated by the spring 54 thereby defining the maximum amount the spring may bias the handle.

The profile of the rear side 64 of the handle 34 and contact surface 40 of the bushing 30 can be shaped and sized to accomplish many features, functions and benefits, as can the bottom surface 38, depression 66 and stop surface 68. For example, the rear side 64 could have a depression at a location other than the end of the handle 34 or have an increased slope if it is not desired to have as much of the strut 24 withdrawn from the tube 28 when the frame 10 is in the collapsed position.

Figure 10:
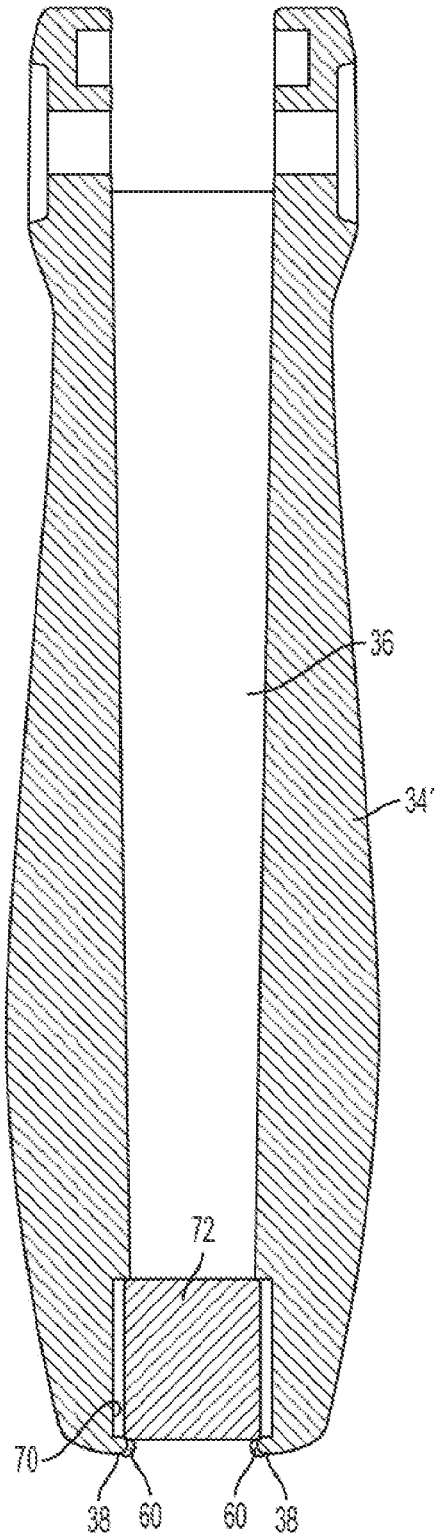
FIG. 10 is a cross-sectional elevation view of an alternative embodiment of a locking member engaged to a structure.

Another embodiment of a securing component is shown in FIG. 10. At the bottom surface 38 of the handle 34 is a bracket 70. The bracket 70 is sized and shaped so as to be able to connect to or clip or snap onto a structure such as a rail or fence 72.

Figure 11:
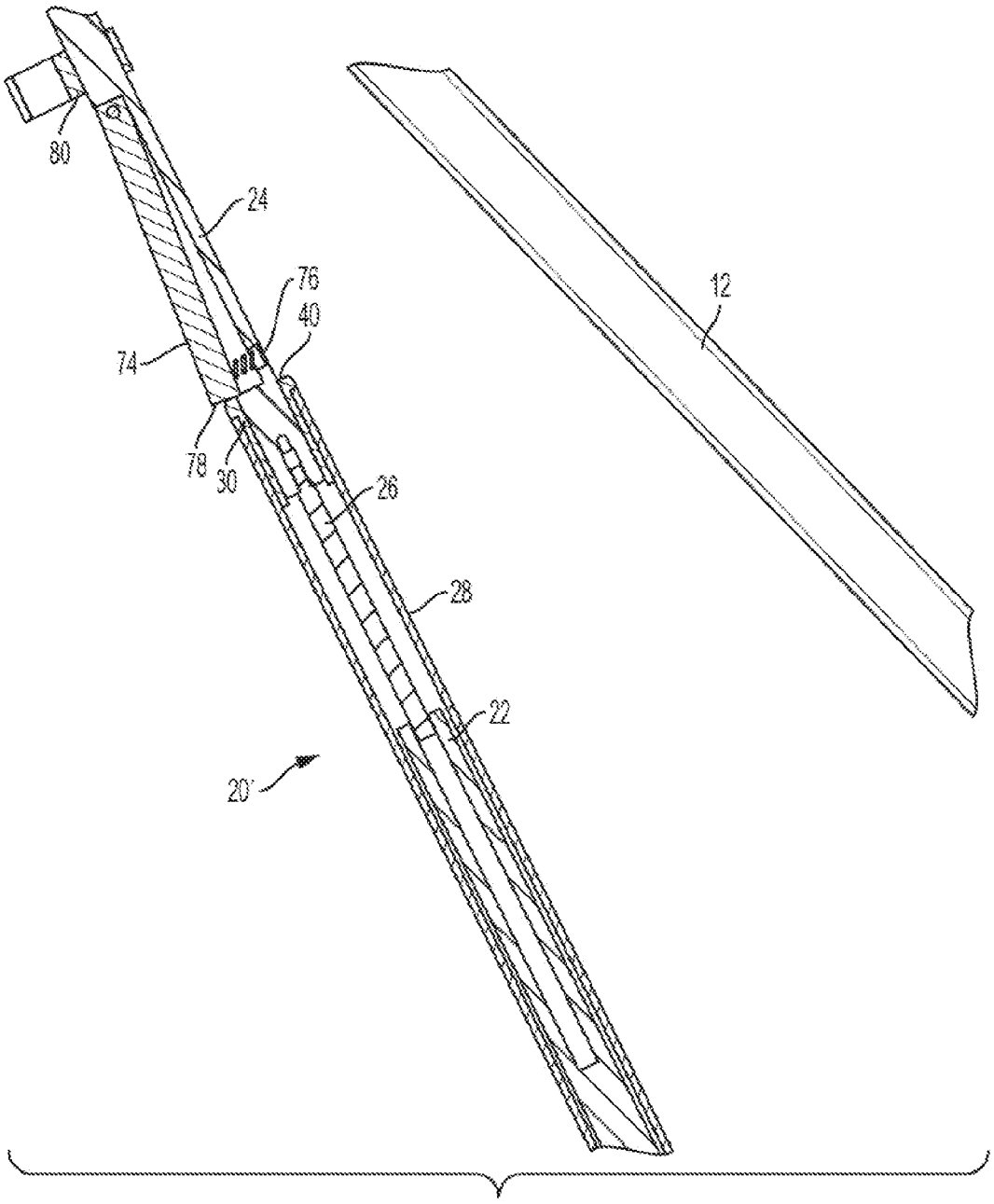
FIG. 11 is a cross-sectional elevation view of an alternative embodiment of a locking member in a closed position.
Figure 12:
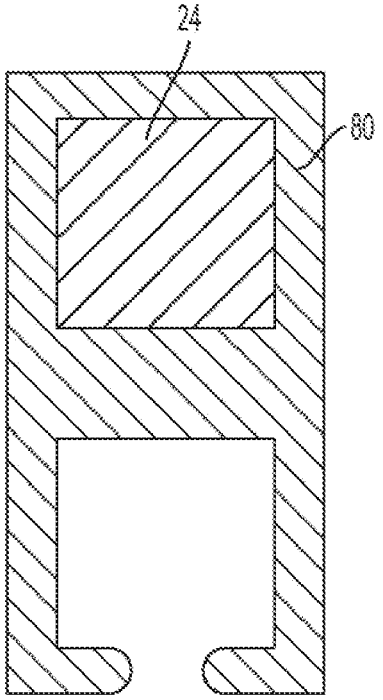
FIG. 12 is a cross-sectional elevation view of the bracket of FIG. 11.
Figure 13:
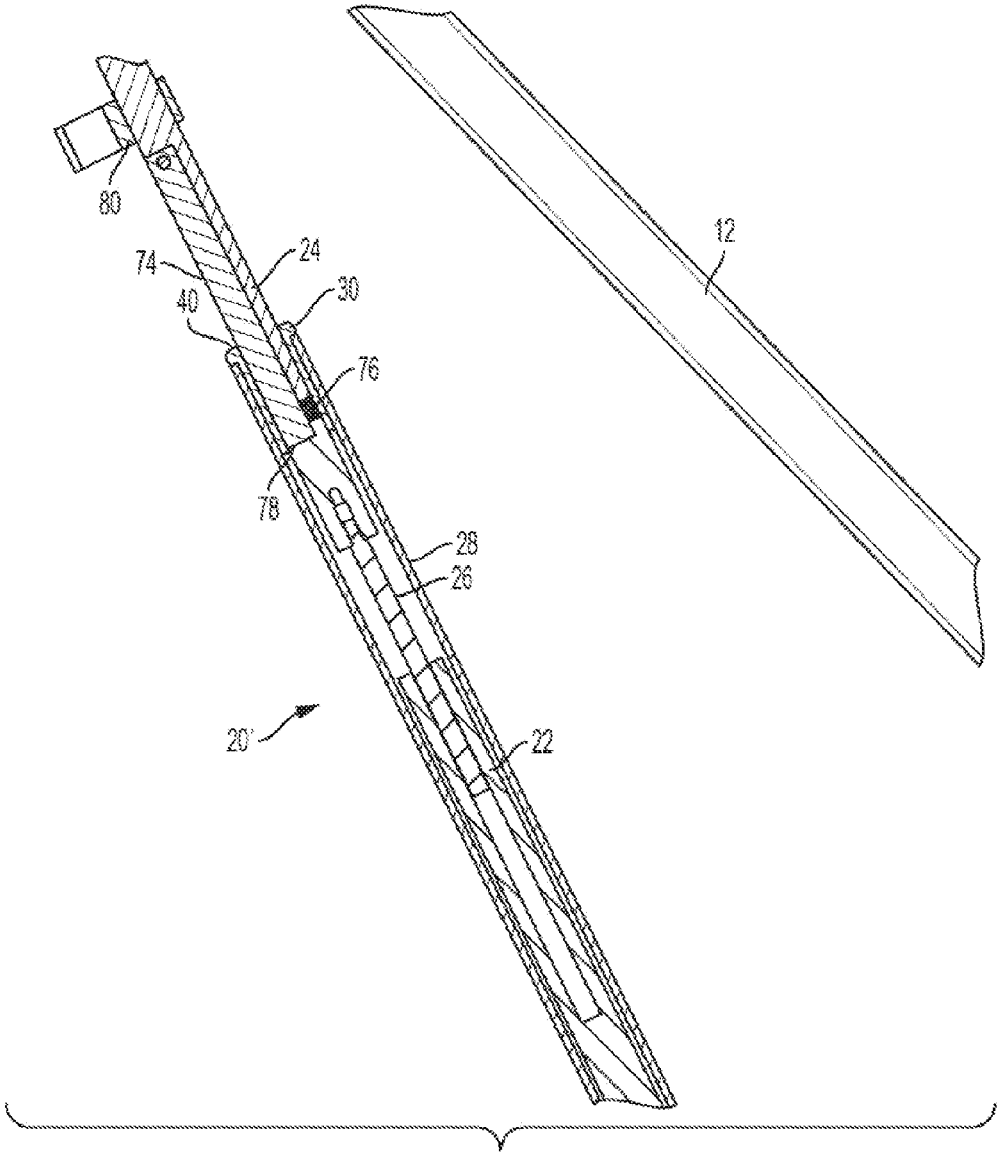
FIG. 13 is a cross-sectional elevation view of an alternative embodiment of a locking member in an opened position.

Another embodiment of a locking member for locking the support member 20' in the engaged position is shown in FIGS. 11, 13. As seen in FIGS. 11, 13, the locking member includes a lever 74 that is pivotally connected to and resides partially within the strut 24. A spring 76 is located between the bottom end of the lever 74 and the strut 24 to urge the bottom end of the lever out of the surface of the strut.

To move the frame 10 from an deployed position towards the collapsed position, the bottom portion of the lever must be operated, e.g. pressed in towards the strut 24, against the force from the spring 76, such that the lever 74 and strut 24 can fit within the bushing 30 and be slid down into the tube 28 as seen in FIG. 13. When the frame is moved from the collapsed position towards the deployed position, and the strut 24 is sufficiently extended out of the tube 28, the spring 76 will urge the lever out of the strut 24. Once the lever 74 is out of the strut 24, the bottom or jam surface 78 of the lever will rest against the contact surface 40 of the bushing 30 to maintain the frame 10 in the deployed position and prevent the strut from being pushed down into the tube 28. The support member 20' could also include a bracket 80, such as an 'H' bracket, similar to that described above with regards to the bracket 70 shown in FIG. 10 to allow the frame 10 to be able to be secured in the collapsed position, such as to a rail or fence.

Figure 14:
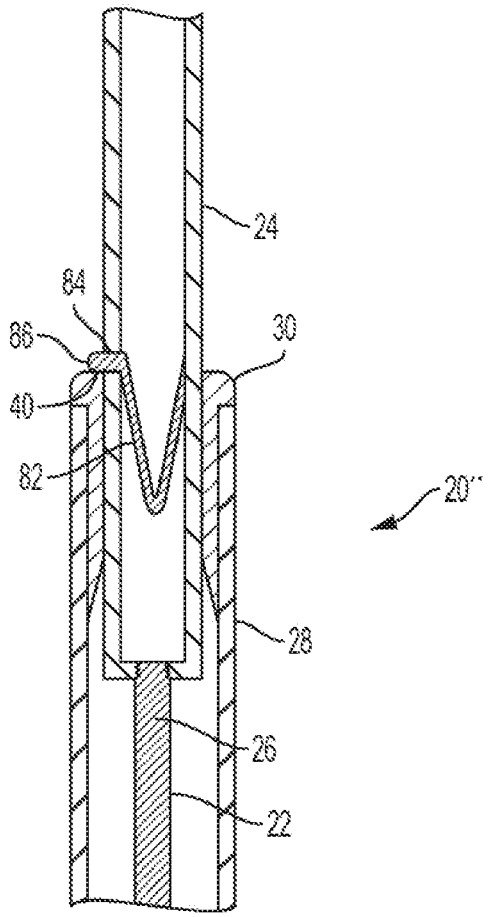
FIG. 14 is a cross-sectional elevation view of an alternative embodiment of a locking member in a closed position.
Figure 15:
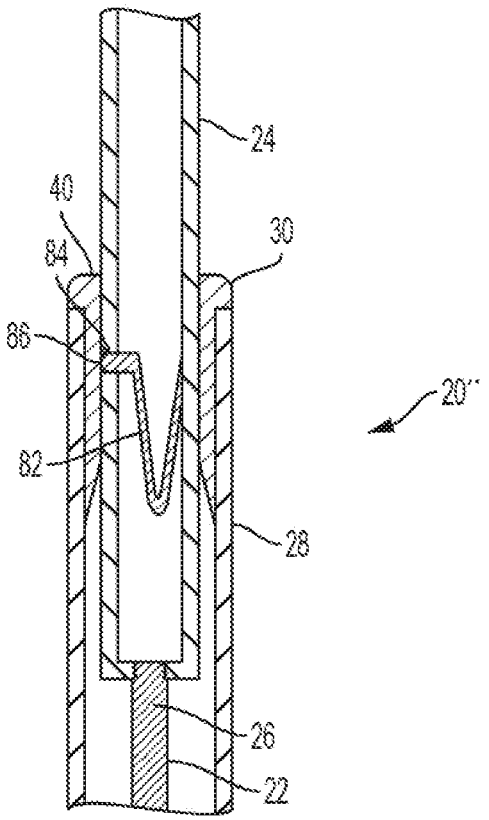
FIG. 15 is a cross-sectional elevation view of an alternative embodiment of a locking member in an opened position.

Another embodiment of a locking member for locking the support member 20" in the engaged position is shown in FIGS. 14-15. As seen in FIGS. 14-15, the locking member includes a spring locking pin 82 that is within the strut 24. When the frame 10 is moved from the collapsed position towards the deployed position, and the strut 24 is sufficiently extended out of the tube 28, a hole 84 will no longer be blocked by the bushing 30 or the tube 28 such that the pin 86 of the spring locking pin 82 will be urged out of the hole. Once the pin 86 is out of the strut 24, the pin will rest against the contact surface 40 of the bushing 30 to maintain the frame 10 in the deployed position and prevent the strut from being pushed down into the tube 28 as seen in FIG. 14. When it is desired to move the frame 10 from the deployed position to the collapsed position, the pin 86 of the spring locking pin 82 can be pushed into the strut 24 so that the strut is free to be withdrawn into the tube 28 as seen in FIG. 15. The support member 20" could also include a bracket 80 as previously described.

Once the frame 10 is in the deployed position, tension must be added to the frame and the frame must be secured to the boat or other structure, e.g. a fence or rail 72. In the embodiment shown in FIG. 16, a support member or ratcheting strut 88 is used to secure the frame 10 to the boat and to add tension to the frame.

Figure 16:
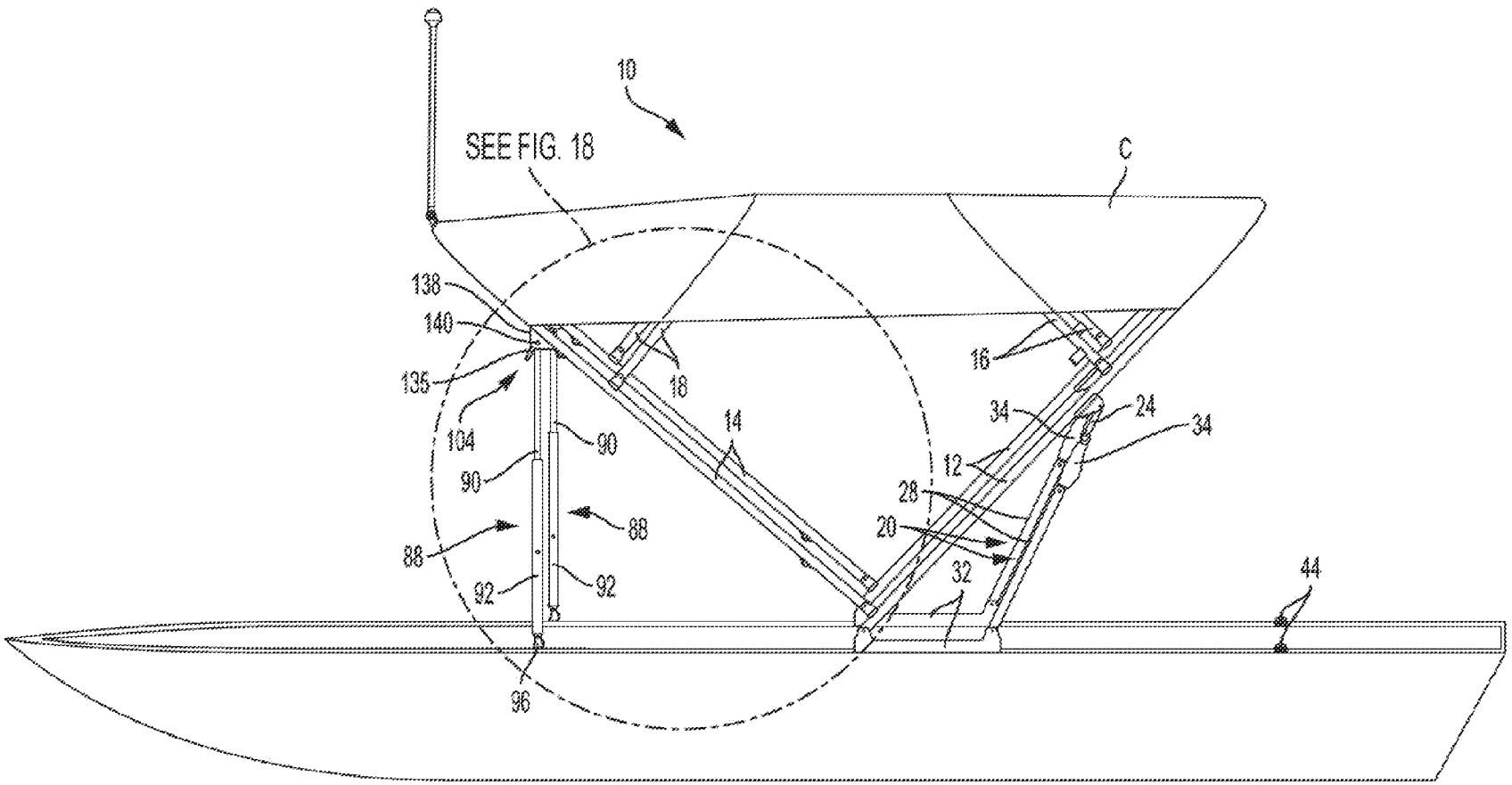
FIG. 16 is an elevation view of a frame in a deployed and secured position.
Figure 17:
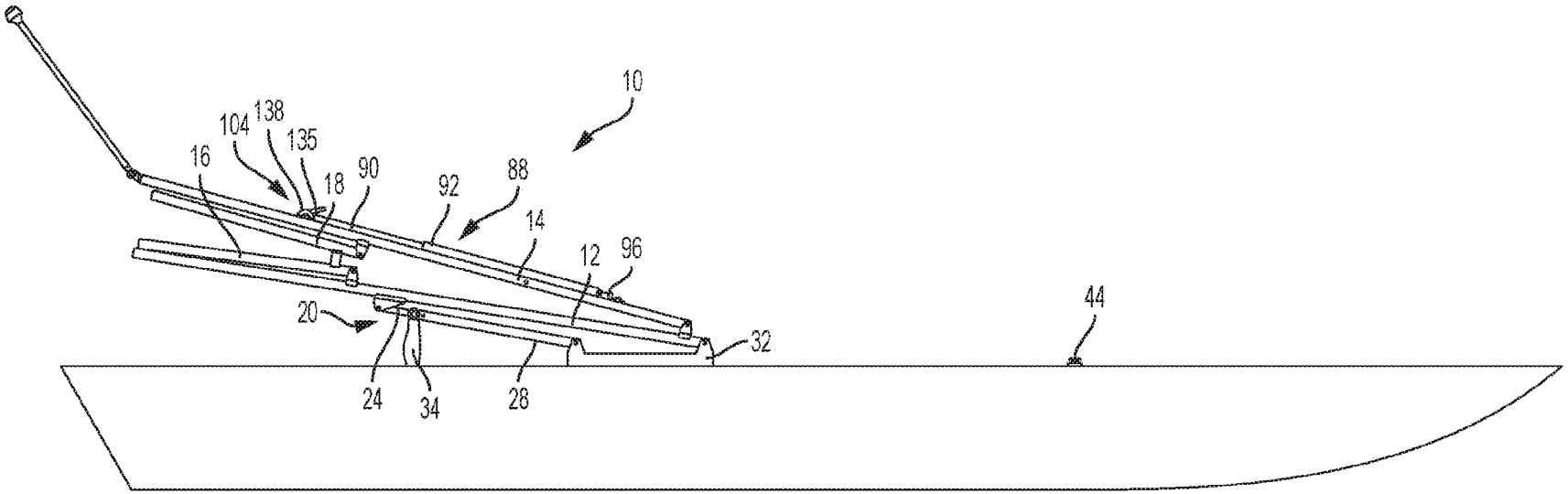
FIG. 17 is an elevation view of the frame of FIG. 16 in a collapsed position.
Figure 18:
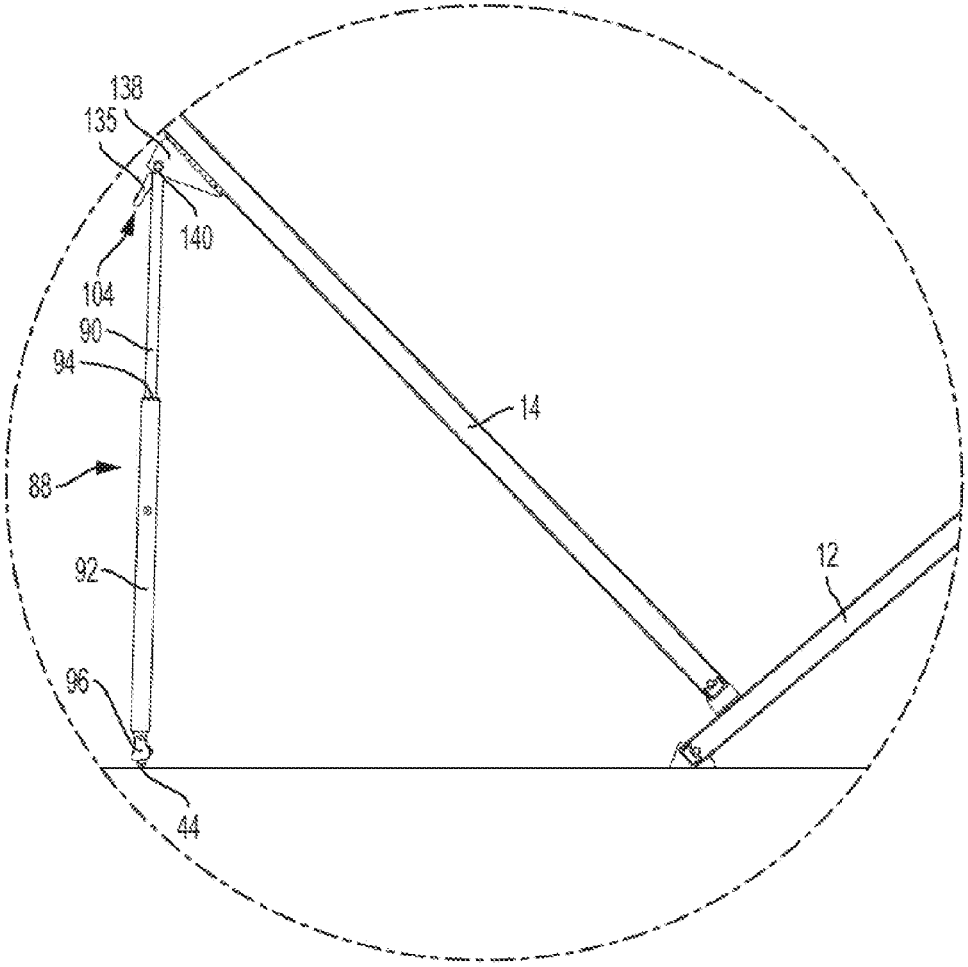
FIG. 18 is an enlarged elevation view of a portion of the frame of FIG. 16 attached directly to a water craft taken along the boundary 18 in FIG. 16.
Figure 19:
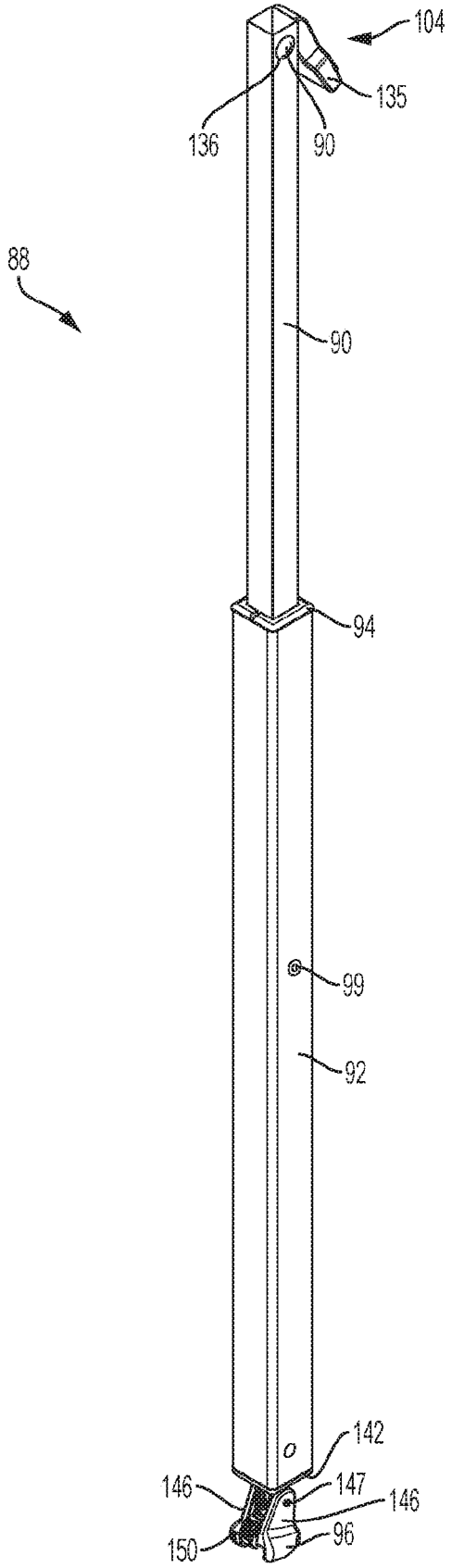
FIG. 19 is an enlarged perspective view of the ratcheting strut of the frame of FIG. 16.
Figure 20:
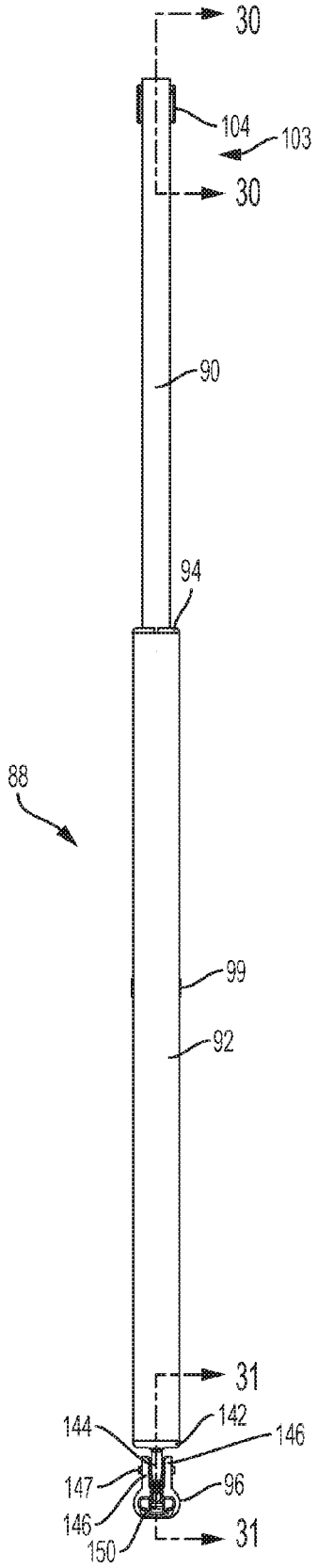
FIG. 20 is a rear elevation view of the ratcheting strut of FIG. 19.
Figure 21:
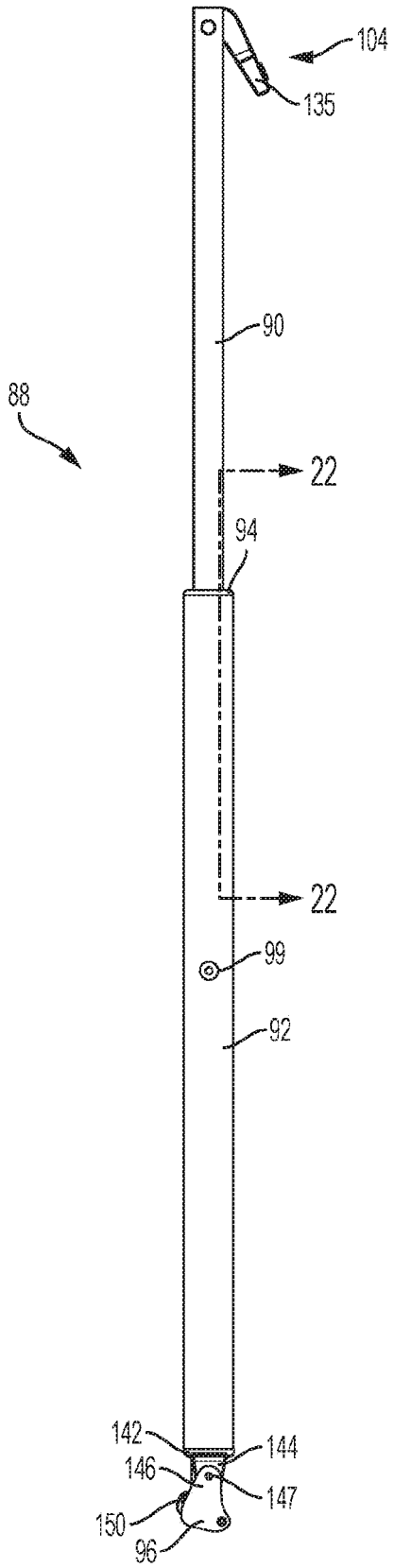
FIG. 21 is a side elevation view of the ratcheting strut of FIG. 19.

The ratcheting strut 88 shown in FIGS. 16-18 has an inner or first member or tube 90 that is pivotally connected to the frame 10, e.g. a bow 12, 14, at a first end and is slidably received in an outer or second member or tube 92 at its second end. In the embodiment shown in FIGS. 19-21, the outer tube 92 has a bushing or collar 94 inserted inside or received by the outer tube at a first or upper end to slidably receive the inner tube 90 and has a latch 96 at its second or lower end.

The bushing 94 can slidably receive the inner tube 90 and help guide the strut as it slides in and out of the outer tube 92, such as, for example, by keeping the inner tube centered, providing a smooth surface for the inner tube to slide against and the preventing the inner tube from undesired racking or twisting. The inside of bushing 94 has a plurality of grooves 98 adjacent the openings 100 in the inner tube 90 as shown in FIGS. 22A-23B and further discussed below. Although in this embodiment, the bushing 94 is shown as a separate piece from the outer tube 92, the two could be integrally formed, over-molded or the outer tube could have grooves along its inner wall. In the embodiment seen in FIG. 22A, the bushing 94 is held within the outer tube 92 by fastener 95, e.g. a barrel nut and bolt. The fastener 99 can serve the dual purpose of holding the bushing 94 in the outer tube 92 and providing a stop to limit the amount the ratcheting mechanism 101 and, thereby, the inner tube 90 can travel within the outer tube 92.

In the embodiment shown in FIGS. 22A-24, the portion of the inner tube 90 that is slideably received by the outer tube 92 has a pair of openings 100 in opposing walls of the inner tube and a ratcheting mechanism 101. Through each opening 100 extends a pawl 102 of the ratcheting mechanism 101. When extended, the pawls 102 engage or are in selective contact with the plurality of grooves 98 on the inside of the bushing 94. A release mechanism 104 is connected to the pawls 102, as will be discussed further below, to selectively withdraw the pawls out of engagement with the grooves 98 of the bushing 94.

Figure 23A:
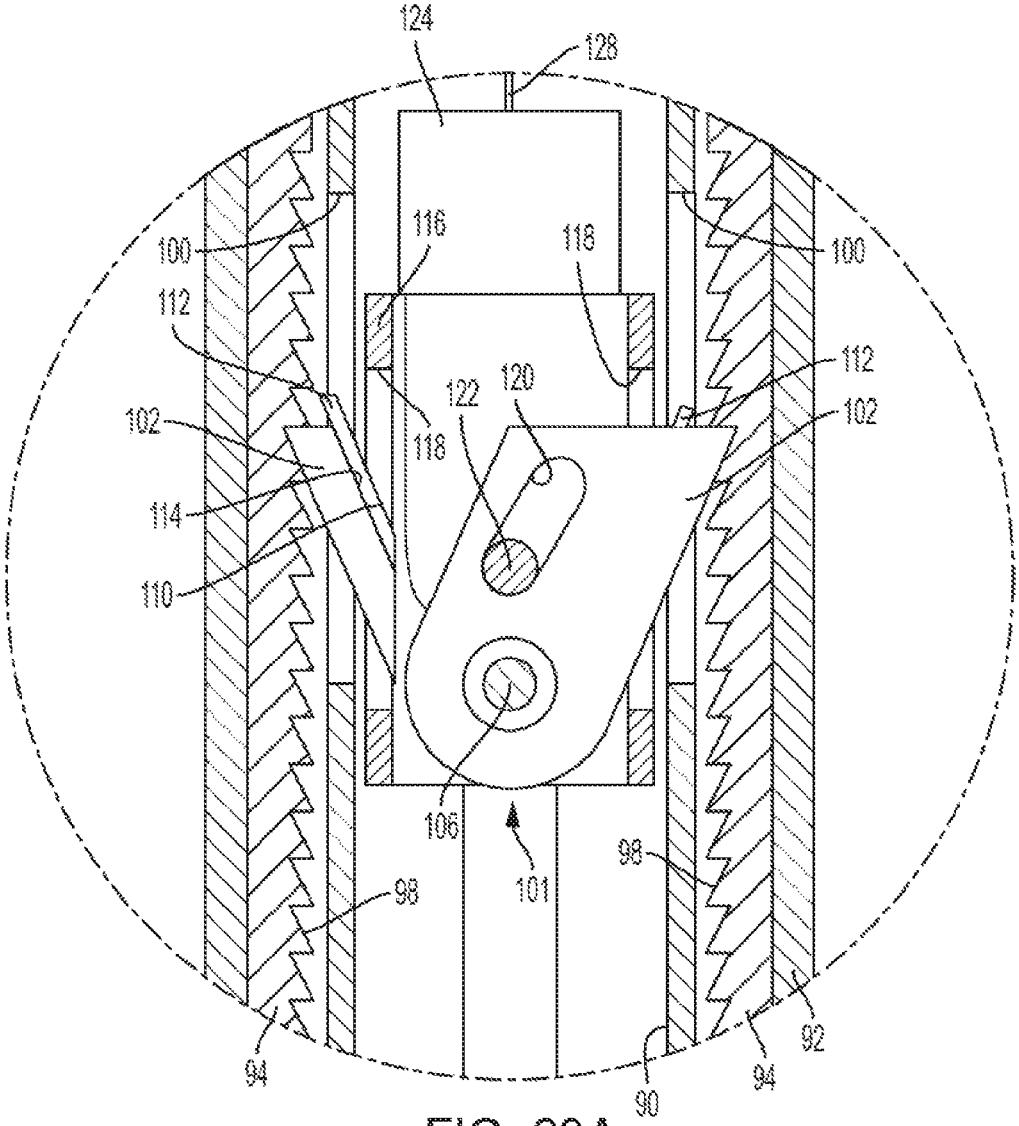
FIG. 23A is an enlarged cross-sectional elevation view of a portion of the ratcheting strut of FIG. 22A taken along the line 23A in FIG. 22A when the release mechanism is disengaged.
Figure 23B:
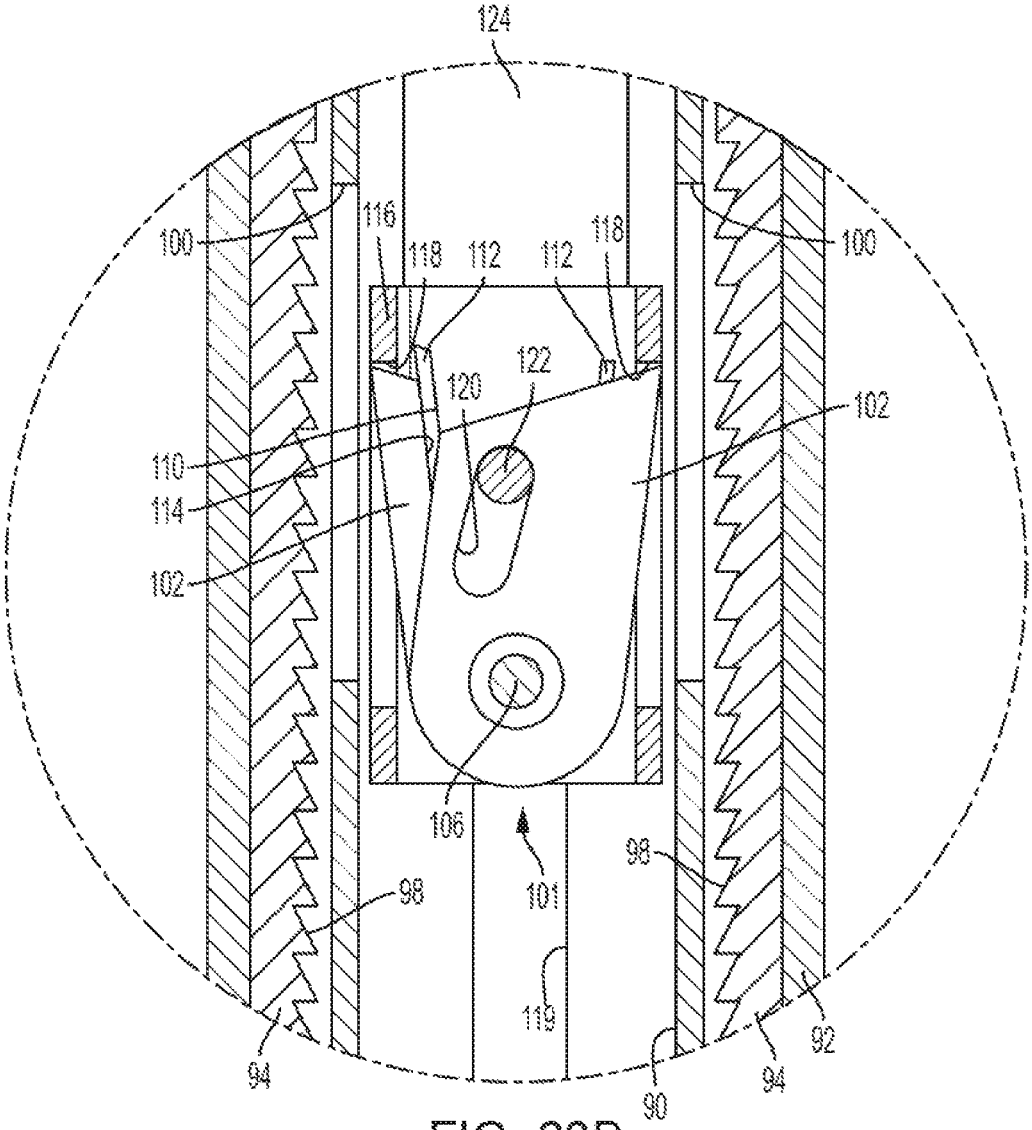
FIG. 23B is an enlarged cross-sectional elevation view of a portion of the ratcheting strut of FIG. 23A when the release mechanism is engaged.

A pin 106 extends through a bore 108 in each pawl such that the pawls 102 pivotally rotate about the pin. As seen in the embodiment shown in FIG. 25-26, the bore 108 is sized such that a tube 109 extends through the bore, and the pin 106 extends through the tube. In this embodiment, the tube 109 provides a smooth bearing surface for the rotation of the pawls 102. The pawls 102 are designed to be the same for ease of manufacturing and assembly, but could be dissimilarly shaped as desired. Between the pawls 102 and wrapped around the tube 109 is a torsion spring 110 as best seen in FIGS. 23A-B. One of each of the ends 112 of the torsion spring 110 rests against and engages an inner contact surface 114 of one of each of the pawls 102 to urge rotation of the pawls away from each other, out of the openings 100 and into engagement with the plurality of grooves 98 of the bushing 94. In the embodiment shown in FIG. 23A, the pawls rotate away from each other to engage a plurality of grooves 98 on opposite sides of the bushing 94 when the release mechanism 104 is disengaged.

Figure 22A:
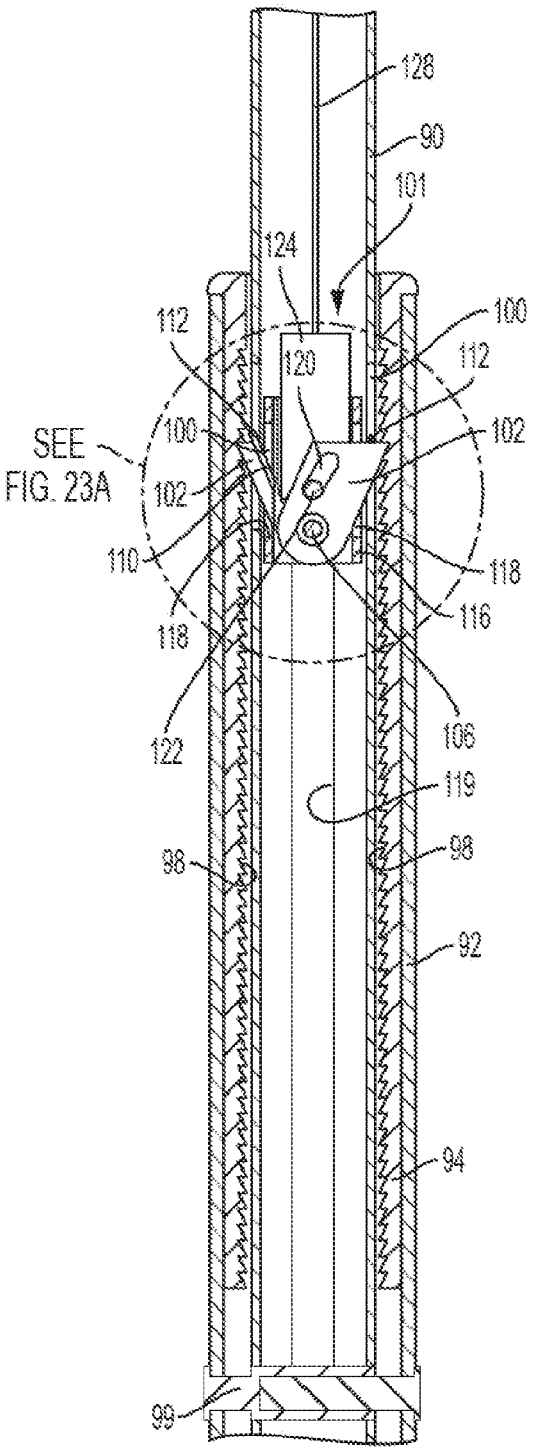
FIG. 22A is a cross-sectional elevation view of a portion of the ratcheting strut of FIG. 21 taken along the line 22A-22A in FIG. 21.
Figure 22B:
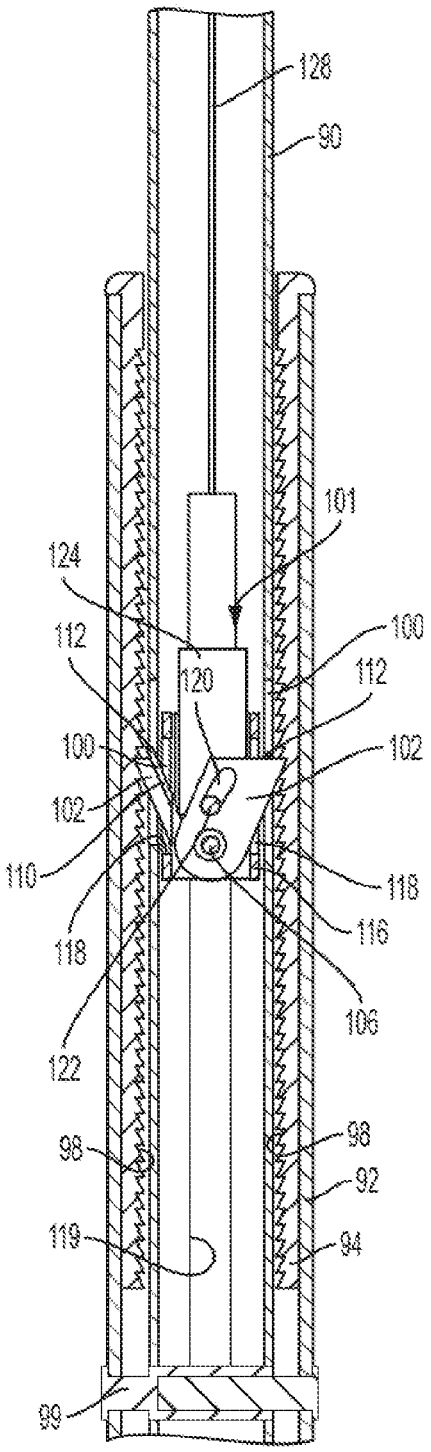
FIG. 22B is a cross-sectional elevation view of a portion of the ratcheting strut of FIG. 22 with the inner tube further within outer tube.
Figure 24:
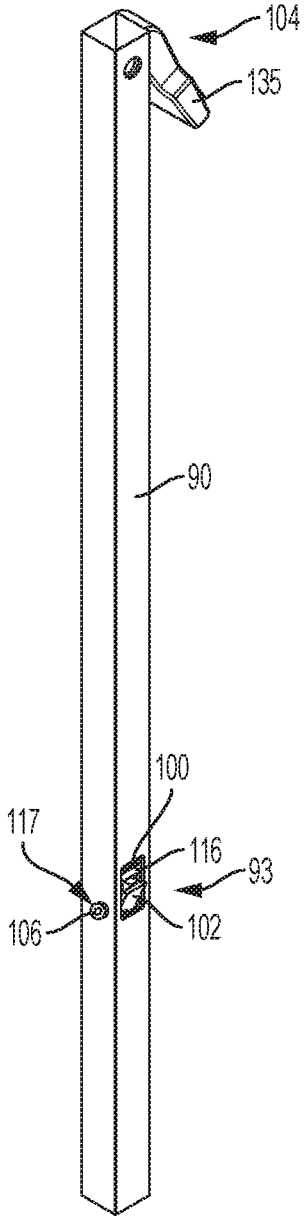
FIG. 24 is an enlarged perspective view of the inner tube of the ratcheting strut of FIG. 19.
Figure 25:
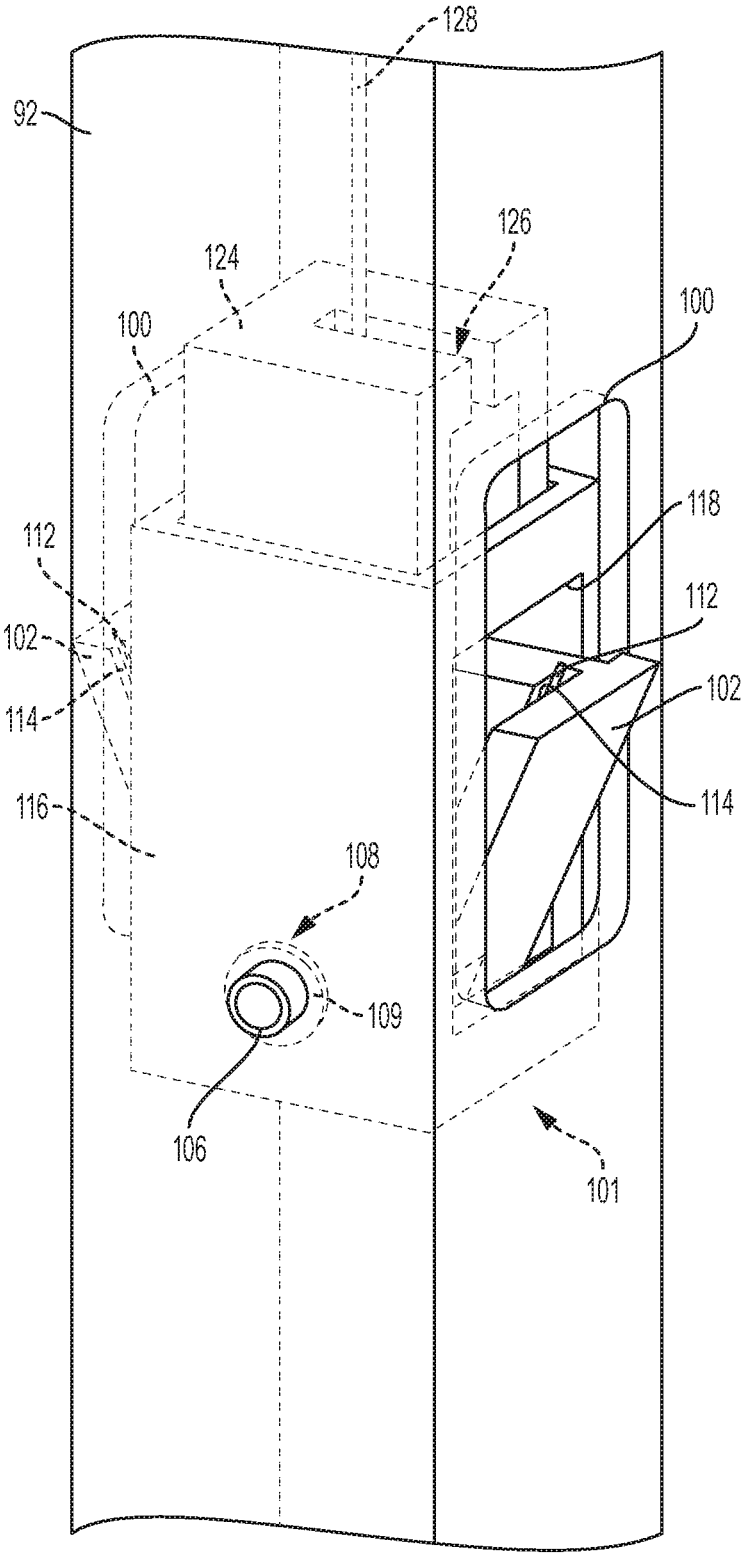
FIG. 25 is an enlarged perspective view of the outer tube and ratcheting mechanism of FIG. 19 with the inner tube removed and hidden surfaces shown in phantom lines when the release mechanism is disengaged.
Figure 26:
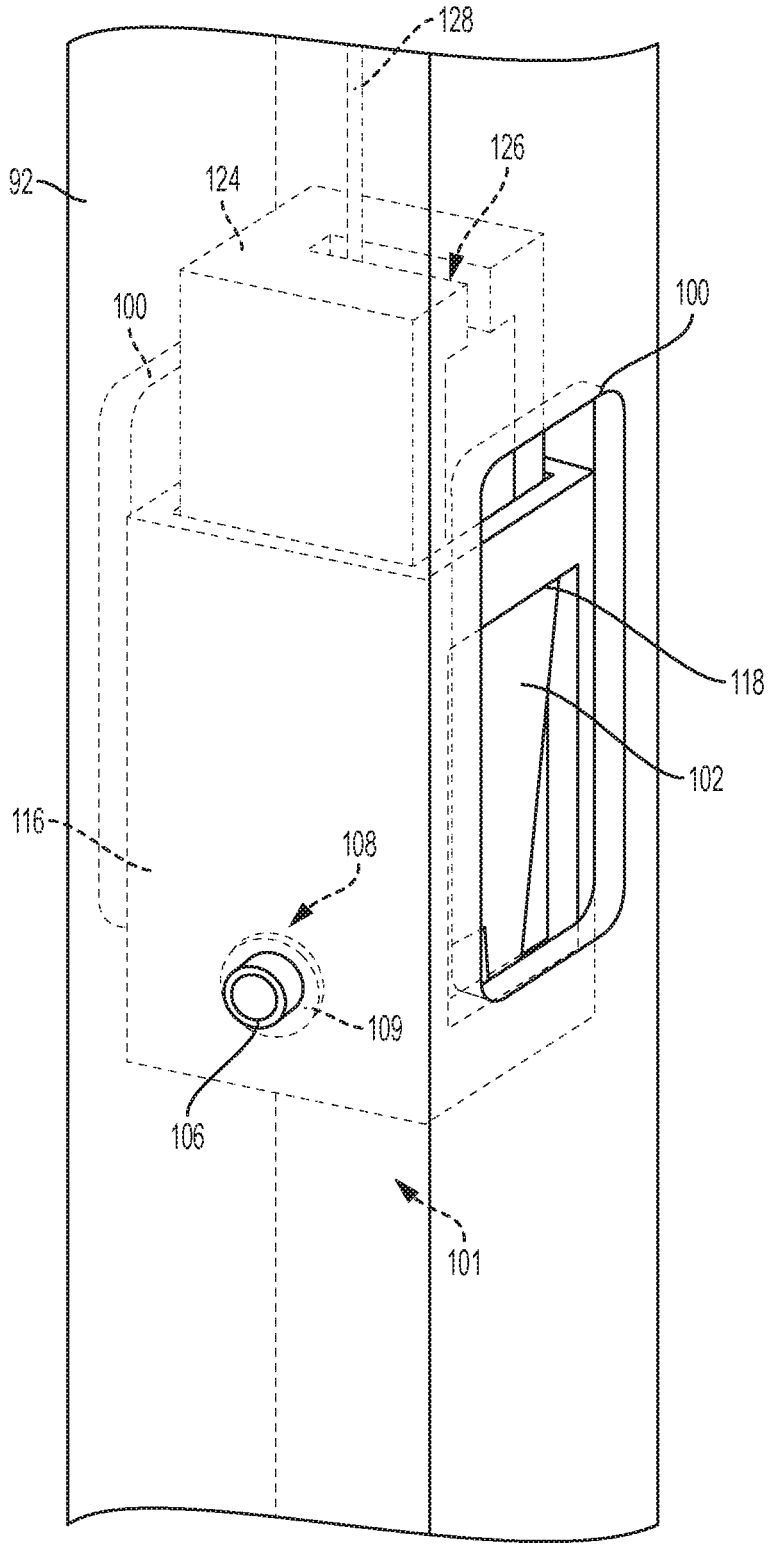
FIG. 26 is a perspective view of the outer tube and ratcheting mechanism of FIG. 25 when the release mechanism engaged.
Figure 27:
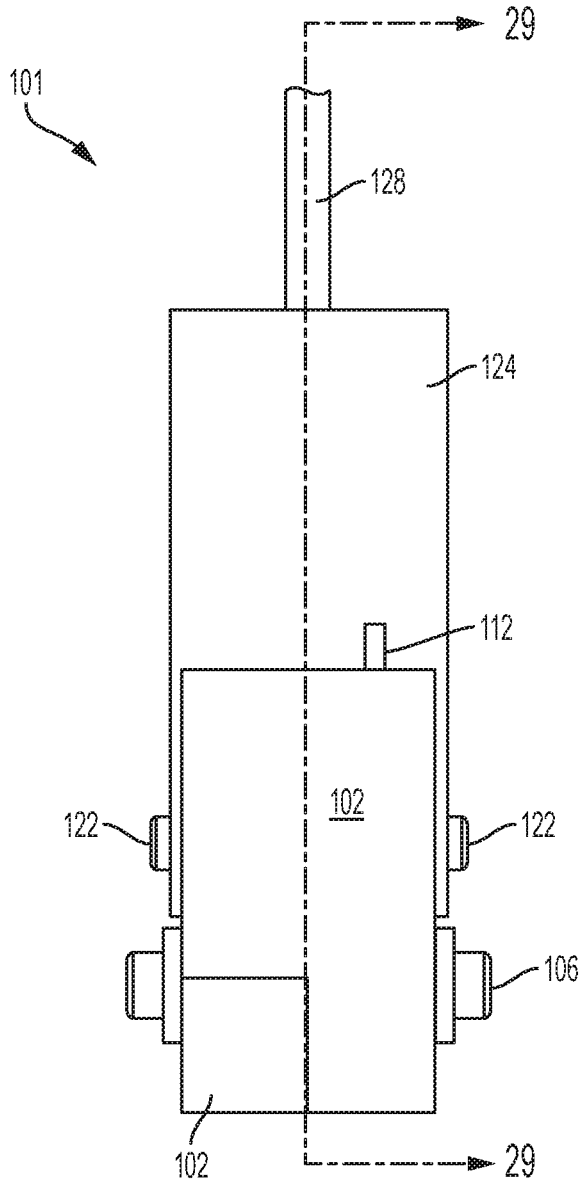
FIG. 27 is an enlarged side elevation view of an alternative embodiment of a ratcheting mechanism.

In the embodiment shown in FIGS. 26-27, the pawls 102 and spring 110 are at least partially within the housing 116 and pivotally connected to the housing by the pin 106 and tube 109. The pin 106 extends beyond the housing 116 and through in holes 117 in the inner tube 90 such that as the inner tube is raised and lower, the ratchet mechanism 101 is correspondingly raised and lowered therewith as seen in FIGS. 24-26. As seen in FIG. 24, the pin 106 extends beyond the inner tube 90 and, as seen in FIGS. 22A-B, rides within a channel 119 formed in opposite sides of bushing 94 adjacent the sides with the plurality of grooves 98. The channel 119 does not extend the entire length of the bushing 94. The channel 119 stops a distance below the top of the bushing 94 such that when the pin 106 reaches the top end of the channel 119, the pin is prevent from being moved further upward and, thereby, the inner tube 90 from being further withdrawn from and out of the outer tube 92. The housing 116 also includes a pair of windows 118 that are adjacent the openings 100 in the inner tube 90 to allow the pawls 102 to extend through the windows 118 and the openings 100. Although a first and second pawl 102, two windows 118 and two openings 100 are illustrated in the embodiment in shown in FIGS. 26-27, more or less pawls, windows and openings could be used.

As seen in FIGS. 23A-B, each pawl 102 also has a slot 120. A shaft 122 extends through or engages both slots 120 of the pawls 102. Each end of the shaft 122 extends beyond the pawls 102 and is received or secured by a carriage 124 as seen in FIG. 27. The carriage 124 of the embodiment shown in FIGS. 25-27 is generally an "A" shape with the pawls 102 being in-between the downwardly extending arms of the carriage. The carriage 124 is slidably received in the top of the housing 116.

The carriage 124 has a slit 126 at its top. The slit 126 receives a cable 128 that culminates an enlarged or capped end 130 (seen in FIGS. 28-29) to prevent the cable from being pulled through the slit. Other means are known to a person having ordinary skill in the art for connecting or attaching a cable to a carriage, e.g. a hook to which the cable is tied, the use of which would defeat the spirit of the invention. In the embodiment shown in FIGS. 25-26, a slit 126 is used for ease during manufacture, e.g. an enlarged end 130 may be applied the cable 128 before the cable is inserted through the slit 126. The slit 126 is sized such that during assembly, a part of the cable 128 can fit through the slit and be positioned in the carriage, but the enlarged end 130 cannot.

Figure 28:
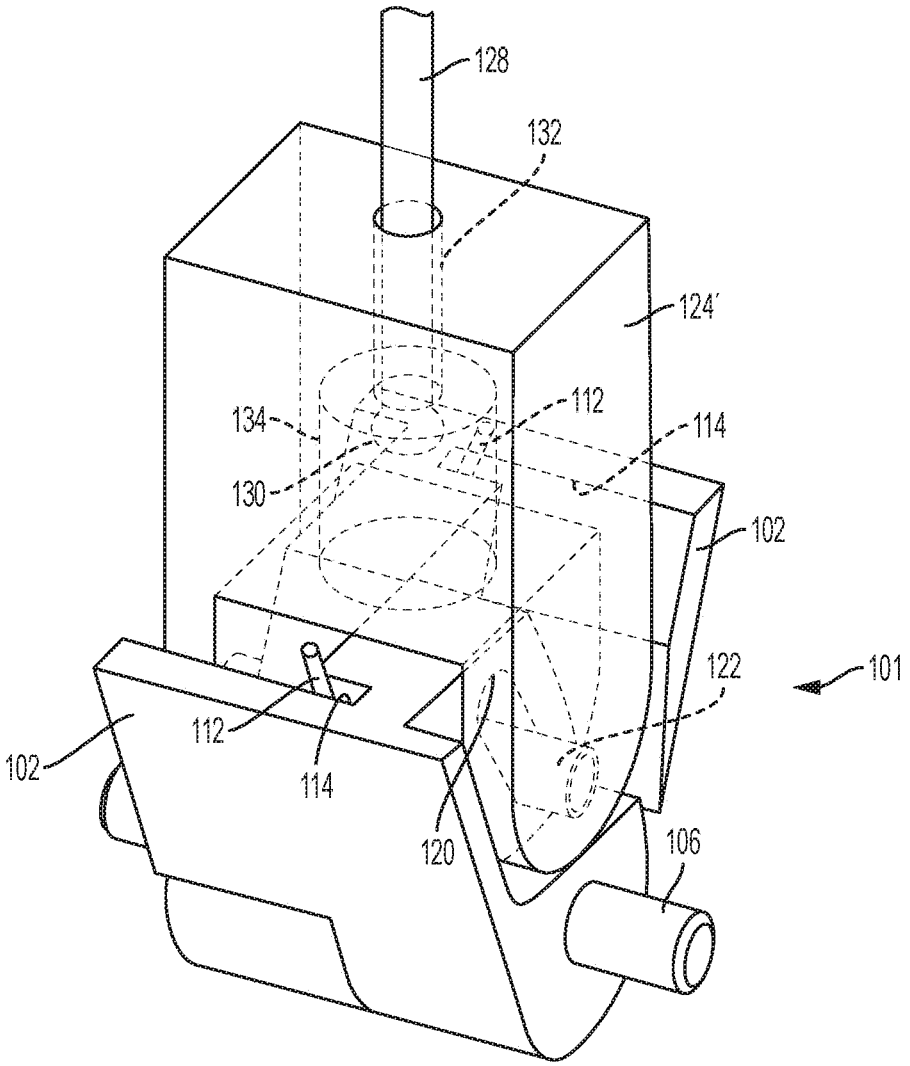
FIG. 28 is a perspective view of the ratcheting mechanism of FIG. 27 with hidden surfaces shown in phantom lines.
Figure 29:
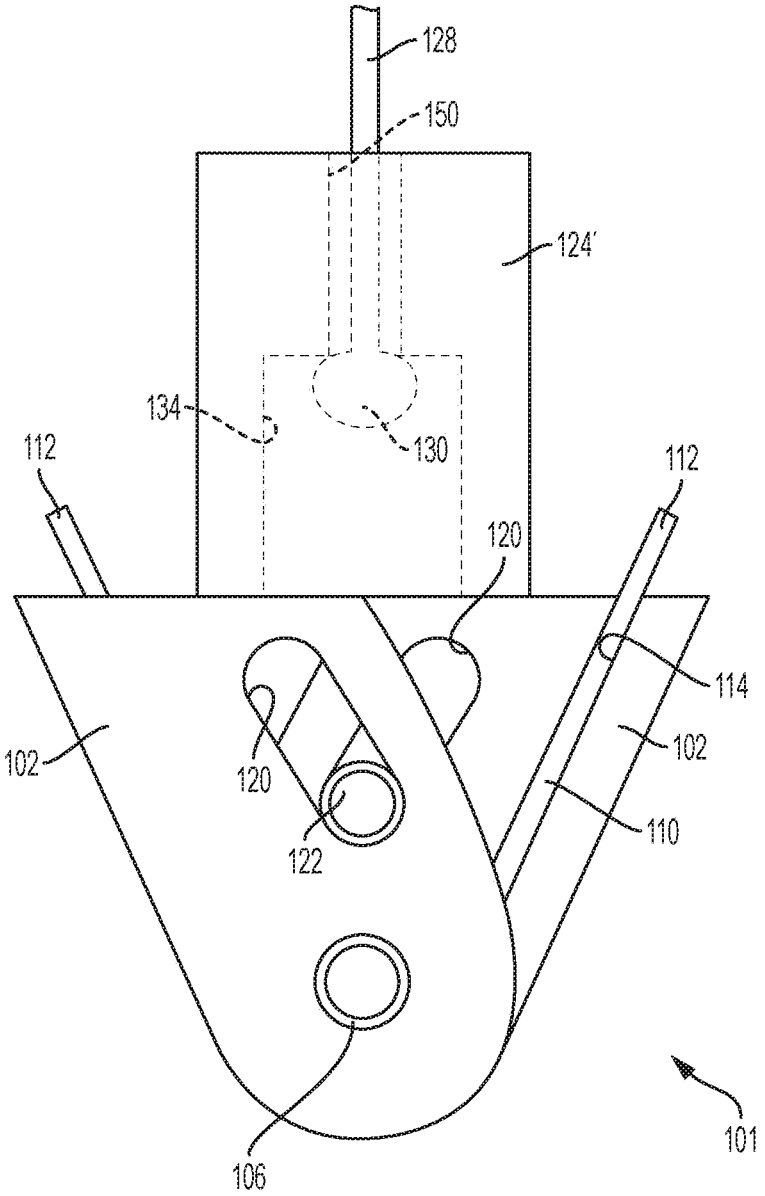
FIG. 29 is a cross-sectional front elevation view of the ratcheting mechanism of FIG. 27 taken along the line 29-29 in FIG. 27.
Figure 31:
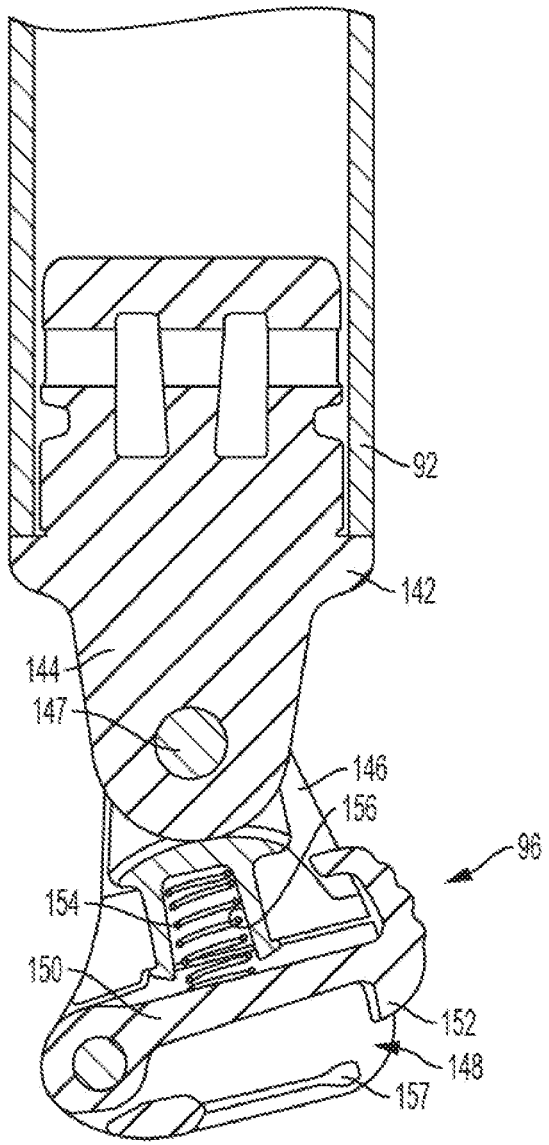
FIG. 31 is an enlarged cross-sectional side elevation view of the latch of FIG. 20 taken along the line 31-31 in FIG. 20.
Figure 32:
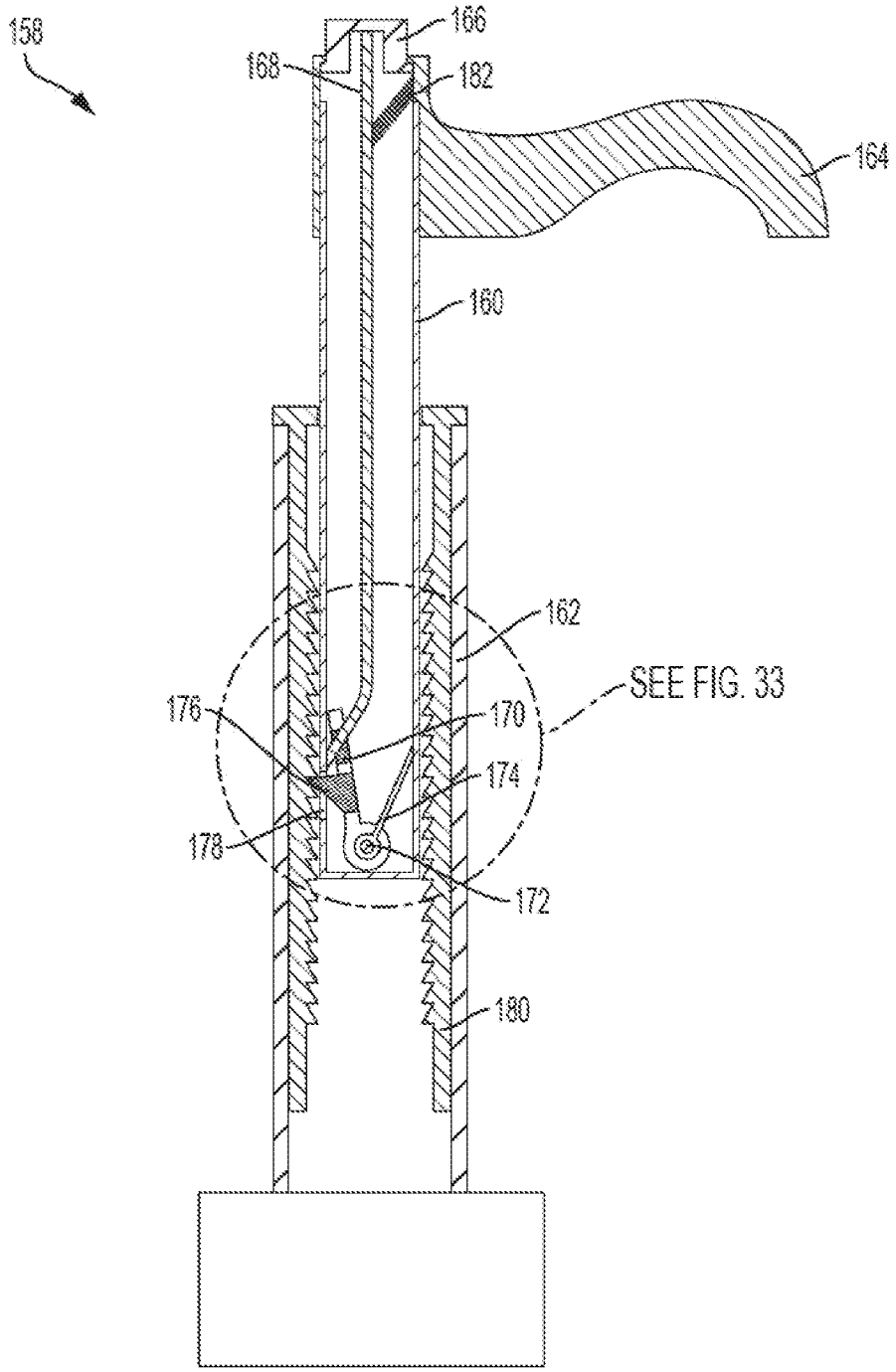
FIG. 32 PRIOR ART
FIG. 32 is a cross-sectional front elevation view of a ratcheting arm of a prior art bicycle rack.

In an alternate embodiment, the carriage 124' could have a more solid top portion with a bore 132 leading to a cavity 134 instead of a slit 126 as seen in FIGS. 28-29. During assembly, a part of the cable 128 would be inserted through the bore 132 until an end is in the cavity 134. Then, the cable 128 could receive an enlarged end 130 or other means that can fit within the cavity 134 but does not fit within the bore 132 to secure or connect the cable to the carriage 124. Enlarged ends 130 are known to a person having ordinary skill in the art, e.g. a nut, washer, cable ends, etc., the use of which would not defeat the spirit of the invention. The ratcheting mechanism 101 seen in FIGS. 31-32 is simplified in that it does not include a housing 116 or a tube 109, however, the mechanism could include such components if desired.

The cable 128 runs up through the inner tube 90 and is secured or connected to the lever 135 of the release mechanism 104 at one end. The lever 135 is pivotally connected to the inner tube 90 as discuss further below. In the configuration seen in FIG. 30, when the lever 135 is pushed or operated, the cable 128 is pulled upwards, towards the top of inner tube 90. Because the cable 128 is secured to the carriage 124 at a second end, movement of the cable upwards causes the carriage to be pulled upwards. Because the shaft 122 is held by the carriage 124, movement of the carriage upwards causes the shaft 122 to move upwards away from its first position. Because the shaft extends through the slots 120 of the pawls 102, as the shaft moves upwards the pawls rotate inwards away and are disengaged from the plurality of grooves 98.

In the embodiment seen in FIGS. 23A-B, the slots 120 are oriented at an angle when the pawls 102 are extended out of the windows 118 and openings 100. As the shaft 122 is pulled upward, the shaft moves up the slots 120. The orientation of the angled slots 120 is such as the shaft 122 moves closer to the top end of the slots, the pawls 102 are rotated inward, towards the inner tube 90, thereby overcoming the spring 110 as seen in FIG. 23B. However, the slots 120 could be designed in any shape and/or orientation to achieve a desired movement of the pawls 102 as is known to a person having ordinary skill in the art, the use of which would not defeat the spirit of the invention.

After the frame 10 is moved from its collapsed or stowed position into the deployed position, as discussed above, the ratcheting strut 88 can be attached to the boat such as by using the latch 96 on a deck button 44, as will be discussed further below. Once the ratcheting strut 88 is attached to the boat, the front of the frame 10 can be pulled down to add tension to the frame 10. Tension is added because the gas shocks 22 of the support members 20 at the rear of the frame are holding the frame downward at the rear or aft of the boat.

As seen in FIG. 23A, the shape of the plurality of grooves 98 of the collar 94 and pawls 102 is such that the pawls can ride down the collar along the plurality of grooves, but cannot be ride up the plurality of grooves. Therefore, as the front of the frame 10 is being pulled down to tension the frame, the inner tube 90 is being pushed further into outer tube 92 and the pawls are riding down the collar 94 along the plurality of grooves 98. As sufficient tension is added to the frame 10, e.g. the front of the frame has satisfactorily been pulled down, the spring 110 will urge the pawls 102 into engagement with the grooves 98 to prevent the tension added to the frame and cover (C) from pulling the inner tube 90 back out the outer tube 92.

The tension added to the frame 10 and cover (C) will cause the frame to have a slightly upwardly bowed shaped due to the frame being held at the front by the ratcheting strut 88 and at the rear by the support member 20. This bowed shape and the tension of the frame 10 and the cover (C) will pull the inner tube 90 upward, which in turn will pull the pawls 102 upward without rotation. This upward action will cause the pawls 102 to engage one of the plurality of grooves 98 to thereby resist the upward force and hold the inner tube 90, frame 10 and cover (C) in the deployed position.

When it is desired to stow the frame 10, the lever 135 can be engaged or pushed toward the inner tube 90. The rotation of the lever 135 causes the cable 128 to be pulled upward. The cable 128 in turn, pulls the carriage 124 and the shaft 122 held thereby upward. As the shaft 122 moves in a first direction, e.g. upward, in the slots 120 of the pawls 102, the pawls are pulled inward, overcoming the outward force of torsion spring 110. In this embodiment, the pushing of the lever must overcome the outward force of the torsion spring 110.

The bowed shape and tension of the frame 10 and the cover (C) pulling the pawls 102 into engagement with one of the plurality of grooves 98 will cause a jamming action between the pawls and grooves. The jamming action in combination with the frictional forces between the pawls and grooves may be such that the lever 135 cannot be easily pressed when the frame 10 is in the deployed position. Therefore, one may pull down slightly on the frame 10 to remove the jamming action and then press the lever 135. However, even this maneuver can be accomplished by a single person with one hand on the frame 10 and another on the lever 135.

Once the lever 135 is pressed and held, the frame 10 can be moved upward to release the tension in the frame and cover (C). With the tension removed, the latch 96 can be disengaged from the deck button 44, as will be described further below. If the ratcheting strut 88 is being used with the support member 20, the handle 34 can be rotated outward and the frame 10 can be collapsed into its stowed position.

Figure 30:
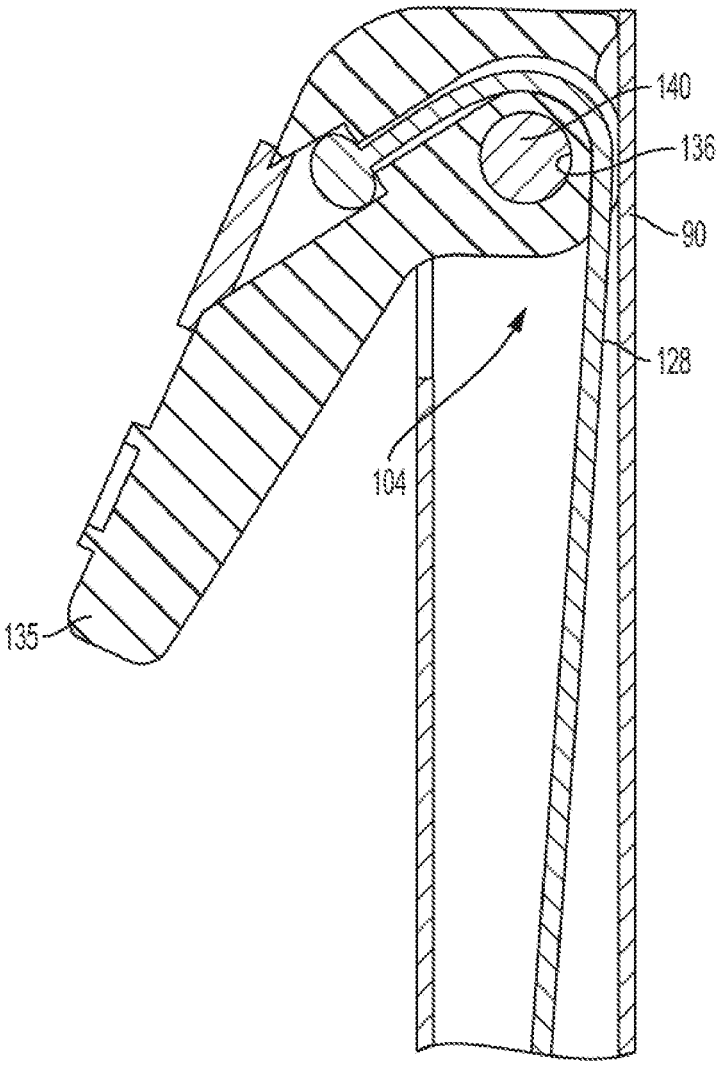
FIG. 30 is an enlarged cross-sectional side elevation view of the release mechanism of FIG. 20 taken along the line 30-30 in FIG. 20.

In the embodiment seen in FIG. 30, the inner tube 90 includes a hole 136 near the end of the inner tube that connects to the frame 10. For example, a frame bracket 138 is secured to the bow bow 14, such as by screws or bolts. The frame bracket 138 has at least one hole that lines up with the hole 136 in the inner tube 90. Plastic hat-style washers (not shown) may be inserted in each of the holes. A fastener 140, e.g. mating shoulder bolts, may be inserted through the hole in the frame bracket 138, hat-style washers and hole 136 in the inner tube 90 to pivotally connect the inner tube 90 to the frame 10. Other means are known in the art for pivotally attaching a tube to a frame, e.g. a pin, the use of which would not defeat the spirit of the invention. In the embodiment seen in FIG. 30, the fastener 140 pivotally connects the inner strut 90 and, thereby, the ratcheting strut 88 to the bow bow 14 and, thereby, the frame 10 and the lever 135 to the inner strut.

In the embodiment seen in FIG. 31, the outer tube 92 includes an insert 142 and with a projection 144. The insert 142 is inserted into the lower end of the outer tube 92 to secure the insert to the outer tube. The projection 144 that extends from the outer tube 92 and insert 142 is used to attach the outer tube to the latch 96.

In the embodiment seen in FIG. 31, the projection 144 is received between flanges 146 on the latch 96. For example, the projection 144 may have a bore (not shown) formed in one end and a plastic hat-style washer (not shown) inserted in each side of the hole. The flanges 146 are sized to accept the projection 144 and the flanges have a hole matching the hole in the hat-style washers such that a fastener 147 may be inserted through the holes in the flanges 146, hat-style washers and projection 144 to pivotally connect the outer tube 92 to the latch 96.

Many such fasteners 147 are known in the art, the use of which would not defeat the spirit of the invention, e.g. pin, bolt, etc. The latch 96 and insert 142 and/or outer tube 92 could also be rigidly attached, e.g. by welding, gluing or being integrally formed. However, being pivotally connected allows the ratcheting strut 88 to be attached to the frame 10 in a less precise manner because the latch 96 and/or tubes 90, 92 can be pivoted to receive a deck button 44 even if the ratcheting strut is not perfectly aligned with the deck button.

As seen in the embodiment shown in FIG. 31, the latch 96 includes a mouth 148 at the end opposite the projection 144 or the bottom of the latch to receive a structure. A lever 150 is located above the mouth 148. The lever 150 is pivotally attached to the latch 96 at the rear. At the front of the latch 96, the lever 150 includes a hook or lip 152. The front, exterior surface of the hook 152 is rounded or angled. A spring 154 is located in a cavity 156 of the latch 96 to urge the lever 150 downward into the mouth 148 such that the hook 152 closes the entrance to the mouth. In the embodiment shown in FIG. 31, the lever 150 is a spring loaded lever.

When the frame 10 is partially deployed and the ratcheting strut 88 extended, e.g. inner tube 90 pulled out of outer tube 92, mouth 148 of the latch 96 can be lined up to receive the deck button 44. As the latch 96 is moved towards the structure, e.g. deck button 44, the structure will contact the rounded exterior surface of the hook 152. The shape of the exterior side of the hook 152 cooperates with the deck button 44 to force the lever 150 upwards, overcoming the force of the spring 154. With the lever 150 out of the way, the deck button 44 can be seated in the mouth 148 of the latch to secure the latch 96 to the deck button.

Once the deck button 44 has cleared the exterior side of the hook 152, the spring 154 will urge the lever 150 back down, wherein the hook will secure the deck button in the mouth 148 of the latch 96. The mouth 148 may also include a ridge 157 to help seat and further secure the deck button 44 in the mouth.

When it is desired to release the deck button, e.g. to return the frame 10 to the stowed position, the hook 152 can be moved upwards, e.g. by a thumb, to clear the entrance to the mouth 148 of the latch 96 and the latch slid away from the deck button. Alternatively, the latch 96 could be designed to secure to a rail or fence 72 or other structure commonly found on a marine vehicle.

At least one bicycle rack company, Küat Inc., has incorporated a ratcheting arm into a bicycle rack. One model offered by Küat Inc. is called The NV. The NV is a bicycle rack for two bicycles. Each bicycle space includes a ratcheting arm 158 that fits over a bicycle tire to help hold the bicycle in the rack.

As seen in FIG. 32, the ratcheting arm 158 includes a first pole 160 that fits within a second pole 162. The first pole 160 includes a tire hook 164 at its end opposite the end inside of the second pole to hold a tire on a bicycle. The second pole 162 is pivotally attached to the bicycle rack to move the ratcheting arm around and over the bicycle tire. The end of the first pole 160 with the tire hook 164 also includes a release button 166 to allow the first pole to be pulled out of the second pole 162.

The release button 166 is connected to a metal rod 168. At the end opposite the release button 166, the metal rod 168 is bent so that the end of the metal rod rides against the inside of the first pole 160 when the release button is pushed. A ratchet member 170 is located towards the end of the first pole 160 opposite the release button 166. The ratchet member 170 is pivotally connected to the first pole 160 by a bolt 172 that extends through a first hole in a wall of the first pole, through a hole in the ratchet member and then out a second hole in an opposite wall of the first pole and secured with a nut.

The ratchet member 170 is generally "H" shaped. In the top, open portion of the "H" shaped ratchet member 170, the bent portion of the rod passes through to contact the inside of the first pole 160. In the bottom open portion of the "H" shaped ratchet member 170, a torsion spring 174 is wrapped around the bolt 172. One end of the spring 174 abuts the inside of the first pole 160 opposite the side which the rod 168 contacts. The second end of the spring 174 (not shown) rests against the inside surface of the ratchet member 170 and urges the ratchet member to pivot such that the top end of the ratchet member contacts the inside of the first pole 160.

Figure 33:
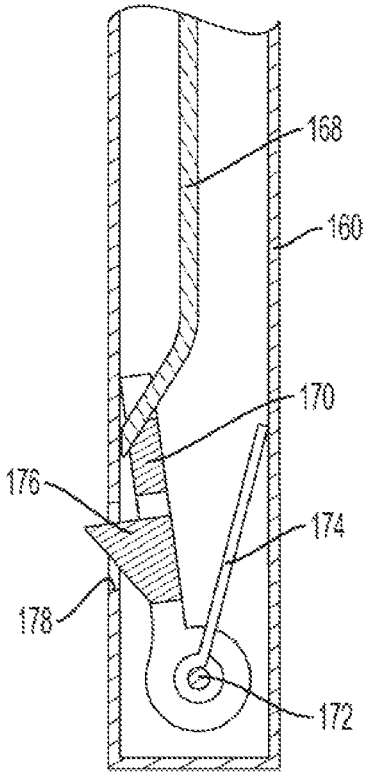
FIG. 33 PRIOR ART
FIG. 33 is an enlarged cross-sectional front elevation view of a portion of the ratcheting arm of FIG. 32 in the engaged position.

The ratchet member 170 also includes a projection 176. The projection 176 extends through an opening 178 in the wall of the first pole 160 when the release button 166 is not depressed as seen in FIGS. 32-33.

A notched sleeve 180 is located on the inside of the second pole 162. The projection 176 contacts the notches in the notched sleeve 180 when the release button 166 is not depressed. When the projection 176 contacts the notches in the notched sleeve 180, the first pole 160 cannot be withdrawn further out of the second pole 162.

Figure 34:
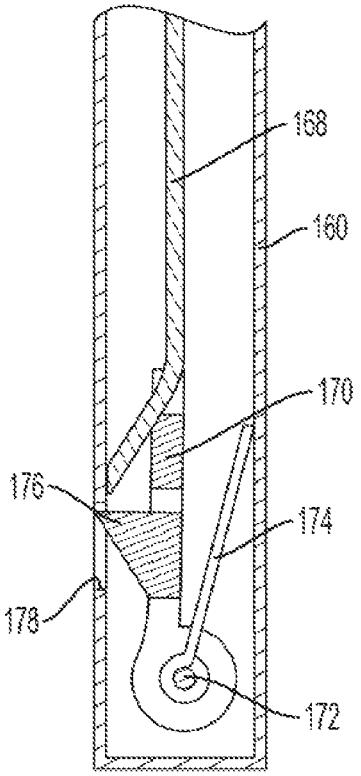
FIG. 34 PRIOR ART
FIG. 34 is a cross-sectional front elevation view of the portion of the ratcheting arm of FIG. 33 in the disengaged position.

When the release button 166 is depressed, the metal rod 168 is pushed downwards along the inside surface of the first pole 160. As the metal rod 168 is pushed downwards, the ratchet member 170 rides up the bent portion of the metal rod. As the ratchet member 170 rides up the bent portion of the metal rod 168, the ratchet member is pivotally rotated away from the inside surface of the first pole 160 against the urging of the spring 174 as seen in FIG. 34. In this position, the projection 176 is not in contact with the notched sleeve 180 and the first pole 160 can be pulled out of the second pole 162.

When the release button 166 is released, a spring 182 connected to the hook 164 on the inside surface of the first pole 160 pulls the metal rod 168 back upwards. As the rod is being pulled upwards, the torsion spring 174 rotates the ratchet member 170 back into contact with the inside surface of the first pole 160. In this position, the projection 176 is in contact with the notched sleeve 180 and the first pole 160 cannot be pulled out of the second pole 162.

This ratcheting arm suffers many disadvantages. First, only one projection 176 contacts the notched sleeve 180. This can result in less resistance to forces pulling the first pole 160 out of the second pole and increased wear on the notched sleeve and projection. Second, the metal rod 168 riding along the inside surface of the first pole 160 can also result in increased wear as well as requiring high precision. For example, if the inside surface has any imperfection during manufacturing, e.g. a burr, or damage during use, e.g. a dent, the metal rod 168 will not be able to slide properly and the device will not work correctly. Third, The NV rack also requires many more parts, e.g. two springs 174, 182 within the poles 160, 162. This can increase overall cost due to the cost of additional parts and additional assembly costs to carefully assemble such parts within the poles.

Although the invention has been herein described in what is perceived to be the most practical and preferred embodiments, it is to be understood that the invention is not intended to be limited to the specific embodiments set forth above. For example, although the support member is described as being used in a frame for a marine top, the support member could be used in a variety of applications including different collapsible structures. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A frame, the frame comprising:

at least one bow;

a first member having a first and second end and a opening, the first end being connected to the at least one bow;

a second member having an upper end and lower end;

a bushing received in the upper end of the second member and having a plurality of grooves along an inner wall, the second end of the first member being slidably received in the bushing;

a housing with at least one window adjacent the opening;

at least one pawl at least partially within the housing and pivotally connected to the housing by a pin;

a spring around the pin and engaged with the at least one pawl such that the at least one pawl is urged out of the opening and the window and into engagement with the plurality of grooves;

a carriage slidably received in the housing;

a shaft extending through a slot in the at least one pawl, the shaft secured to the carriage;

a lever pivotally connected to the first member; and a cable secured to the lever at one end and to the carriage at a second end such that operation of the lever causes the carriage to move upwards and the at least one pawl to rotate away from the plurality of grooves.

2. The frame of claim 1, further comprising:

a second pawl at least partially within the housing and pivotally connected to the housing by the pin;

wherein the spring is engaged with the second pawl such that the second pawl is urged out of a second window in the housing and a second opening in the first member and into engagement with the plurality of grooves;

wherein the shaft extending through a second slot in the second pawl; and wherein operation of the lever causes the second pawl to rotate away from the plurality of grooves.

3. The frame of claim 2, wherein the at least one pawl engages the plurality of grooves on an opposite side of the bushing from the plurality of grooves engaged by the second pawl.

4. The frame of claim 1, wherein the carriage has a slit and the cable has an enlarged end and wherein a part of the cable can fit within the slit, but the enlarged end cannot fit through the slit.

5. The frame of claim 1, wherein the carriage has a bore and the cable has an enlarged end and wherein a part of the cable can fit through the bore, but the enlarged end cannot fit through the bore.

6. The frame of claim 1, further comprising a latch attached to the lower end of the second member.

7. The frame of claim 6, wherein the latch further comprising:

a mouth at a bottom of the latch;

a lever pivotally connected to the latch; and a spring urging the lever into the mouth;

wherein when the lever contacts a structure with sufficient force to overcome the spring, the lever is withdrawn from the mouth to allow the structure to enter the mouth and be secured to the latch.

8. A support member comprising:

a first tube;

a second tube having a plurality of grooves on an inside of the second tube and at least partially slidably receiving the first tube;

a ratcheting mechanism, the ratcheting mechanism comprising:

at least two pawls selectively in contact with the plurality of grooves, wherein each of the at least two pawls has a slot; and a shaft engaging the slot of each of the at least two pawls; and a release mechanism connected to the shaft to selectively move the shaft;

wherein when the release mechanism is disengaged the shaft is in a first position and the at least two pawls are in contact with one of the plurality of grooves and when the release mechanism is engaged the shaft is moved in a first direction and the at least two pawls are moved out of contact with the one of the plurality of grooves.

9. The support member of claim 8, further comprising:

a cable connected at one end to the release mechanism; and a carriage secured to the shaft and connected to a second end of the cable;

wherein when the release mechanism is engaged, the cable and the carriage is pulled towards the release mechanism to move the shaft in the first direction.

10. The support member of claim 9, wherein the release mechanism includes a lever.

11. The support member of claim 9, further comprising a housing slidably receiving the carriage, the at least two pawls being pivotally connected to the housing.

12. The support member of claim 11, wherein the first tube includes the ratcheting mechanism;

wherein the first tube has at least two openings;

wherein the housing has at least two windows; and wherein the at least two pawls extend through the at least two windows and at least two openings to contact the one of the plurality of grooves when the release mechanism is disengaged.

13. The support member of claim 9, wherein the second tube includes a collar and the plurality of grooves are in the collar.

14. The support member of claim 9, wherein the cable extends through a slot in the carriage and culminates in an enlarged end to connect the cable to the carriage.

15. The support member of claim 9, wherein the cable extends through a bore in the carriage and culminates in an enlarged end in a cavity of the carriage to connect the cable to the carriage.

16. The support member of claim 8, wherein the release mechanism is connected to the first tube.

17. The support member of claim 8, further comprising a spring, the spring positioned on the shaft to urge the at least two pawls into contact with the one of the plurality of grooves when the release mechanism is disengaged.

18. The support member of claim 8, wherein the second tube includes a latch.

19. The support member of claim 18, wherein the latch includes a spring loaded lever to secure the latch to a structure.

20. The support member of claim 8, wherein the support member is adapted to be pivotally connected to a canopy of a boat.

* * * * *